US005834176A

United States Patent [19]

Ishikawa et al.

[11] Patent Number: 5,834,176

[45] Date of Patent: Nov. 10, 1998

[54] SILVER HALIDE PHOTOGRAPHIC LIGHT-SENSITIVE MATERIAL

[75] Inventors: Wataru Ishikawa; Seiji Hidaka, both of Hino, Japan

[73] Assignee: Konica Corporation, Tokyo, Japan

[21] Appl. No.: 891,266

[22] Filed: Jul. 10, 1997

Related U.S. Application Data

[63] Continuation of Ser. No. 672,558, Jun. 28, 1996, abandoned.

[30] Foreign Application Priority Data

Jul. 4, 1995 [JP] Japan ..... 7-168846

[51] Int. Cl.[6] ..... G03C 1/09

[52] U.S. Cl. ..... 430/603; 430/264; 430/546; 430/600

[58] Field of Search ..... 430/603, 546, 430/600, 955, 957, 264

[56] References Cited

U.S. PATENT DOCUMENTS

| | | | |
|---|---|---|---|
| 3,615,614 | 10/1971 | Krohn et al. . | |
| 4,629,678 | 12/1986 | Murai | 430/230 |
| 5,187,042 | 2/1993 | Katoh et al. | 430/264 |
| 5,336,592 | 8/1994 | Chino et al. | 430/557 |
| 5,340,695 | 8/1994 | Yamaguchi . | |

FOREIGN PATENT DOCUMENTS

| | | |
|---|---|---|
| 0 349 286 | 1/1990 | European Pat. Off. . |
| 29 38 535 | 4/1980 | Germany . |
| 4-195036 | 7/1992 | Japan . |
| 1 151 413 | 8/1969 | United Kingdom . |

*Primary Examiner*—Thorl Chea

*Attorney, Agent, or Firm*—Frishauf, Holtz, Goodman, Langer & Chick, P.C.

[57] ABSTRACT

A silver halide photographic light-sensitive material is disclosed. The light-sensitive material comprises a support, and a silver halide emulsion layer and optionally a hydrophilic colloid layer provided on the support, in which the silver halide layer comprises a silver halide emulsion chemically sensitized in the presence of fine particles of a water-insoluble sulfur sensitizer which are added to the silver halide emulsion in a form of dispersion of solid particles.

11 Claims, No Drawings

SILVER HALIDE PHOTOGRAPHIC LIGHT-SENSITIVE MATERIAL

This application is a Continuation of application Ser. No. 08/672,558, filed Jun. 28, 1996, now abandoned.

FIELD OF THE INVENTION

The present invention relates to a silver halide photographic light-sensitive material, particularly relates to a black-and-white silver halide photographic light-sensitive material, and a preparation method of silver halide emulsion to be used in the light-sensitive material. Further in detail, the invention relates to a silver halide photographic light-sensitive material for graphic arts and a preparation method of a silver halide emulsion to be used in such the light-sensitive material.

BACKGROUND OF THE INVENTION

A silver halide emulsion to be used in a silver halide photographic light-sensitive material is usually chemically sensitized by means of various kinds of chemical sensitizer. Typical chemical sensitization methods include those using a sulfur sensitizer, a selenium sensitizer, a reducing sensitizer or a combination of these sensitizes. A sulfur sensitization using a labile sulfur compound is most widely and usually used, and is also most basically used in a sensitization with a combination of sensitizers.

Recently, it has been demanded to raise the sensitivity of a silver halide photographic material without any degradation in the granularity and sharpness thereof and to process the light-sensitive material with a rapid processing at a high temperature. However, an increase in the fog formation and lowering in the contrast of the light-sensitive material tend to be caused under conditions for satisfying the above-mentioned demands. Accordingly, improvement in the sulfur sensitization or a combination sensitization based on sulfur sensitization such as sulfur-gold sensitization or sulfur-selenium-gold sensitization is required.

In Japanese Patent Publication Open to Public Inspection (JP O.P.I.) No. 4-195036/1992, for example, a technique in which a sulfur sensitizer other than water-soluble sulfur compounds is previously mixed with a gelatin solution and added to silver halide emulsion for sensitization, is disclosed. The disclosure shows that the fogging is reduced by this technique. However, this method causes problem of formation of black-spots or black pepper spots by infectious development of a silver halide photographic light-sensitive material containing a hydrazine derivative, even though a considerable high sensitivity and high contrast can be obtained. The formation of black-spots is serious problem in a photomechanical process. The black-spot is, for example, a black spot formed at a portion between a dot and a dot where is to be a non-image portion. The formation of black-spots increases when the light-sensitive material is stored under conditions of high-temperature and high-humidity and is considerably accelerated by lowering in the sulfite ion concentration used as a preservative or raising in the pH value in a developer caused by fatigue thereof. The formation of black-spots results considerable degradation in the commercial value of a light-sensitive material for use of graphic art. Further, improvement in the black-spot formation is tend to cause lowering in the sensitivity and γ value of the light-sensitive material. Therefore, a system for improving formation of black-spot without any degradation in the high sensitivity and high contrast of the light-sensitive material is strongly demanded.

SUMMARY OF THE INVENTION

The first object of the present invention is to provide a silver halide photographic light-sensitive material capable of giving photographic properties of a γ value of not less than 10, a high sensitivity and inhibited black-spot formation when the light-sensitive material is processed by a stable developer having a low pH value, and to provide a method for preparing a silver halide emulsion to be used in the light-sensitive material. The second object of the invention is to provide a silver halide photographic light-sensitive material which is inhibited in change of the photographic properties during storage and to provide a method for preparing a silver halide emulsion to be used in the light-sensitive material.

The above-mentioned object of the invention can be attained by a silver halide photographic light-sensitive material comprising a support, and a silver halide emulsion layer and optionally a hydrophilic colloid layer provided on the support, in which the silver halide layer comprised a silver halide emulsion chemically sensitized in the presence of fine particles of a water-insoluble sulfur sensitizer which are added to the silver halide emulsion in a form of dispersion of solid particles.

In a preferable embodiment of the invention, the sulfur sensitizer used in the form of dispersion of solid particles is a water-insoluble thiourea derivative or elemental sulfur. The light-sensitive material preferably contains a hydrazine compound in the silver halide emulsion layer or a hydrophilic colloid layer adjacent to the silver halide emulsion layer. It is preferred that the silver halide emulsion layer or the hydrophilic colloid layer adjacent to the emulsion layer further contains a redox compound capable of releasing a development inhibitor upon oxidation thereof.

DETAILED DESCRIPTION OF THE INVENTION

As preferred examples of the water-insoluble sulfur sensitizer which is added to the silver halide emulsion in a form of dispersion of solid particles of the invention, thiourea derivatives such as 1,3-diphenylthiourea and 1-ethyl-3(2-thiazolyl)thiourea, rhodanine derivatives, dithiocarbamic acids, organic polysulfide compounds, insoluble inorganic sulfur compound and elemental sulfur can be described. As particularly preferred sulfur sensitizer, thiourea derivatives presented by the following Formula I and elemental α-sulfur having orthorhombic crystal system. In the present invention, "water-insoluble sulfur sensitizer" is defined as one havin a a solubility of not more than 0.01% by weight in water at 15° C.

Formula [I]

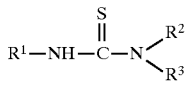

In the formula, $R^1$ is a heterocyclic group including a nitrogen atom or a sulfur atom; $R^2$ is a hydrogen atom, an alkyl group having 1 to 20 carbon atoms, an allyl group or an aryl group; $R^3$ is synonymous with $R^1$ or $R^2$ and $R^2$ may be combined with $R^3$ to form a heterocyclic ring.

In Formula [I], $R^1$ is a heterocyclic group. As examples of the heterocyclic group, residues of pyrroline ring, pyridine ring, quinoline ring, indole ring, oxazole ring, benzoxazole ring, naphthoxazole ring, imidazole ring, benzimidazole ring, thiazoline ring, thiazole ring, benzothiazole ring, naphthothiazole ring, selenazole ring, benzoselenazole ring and naphthoselenazole ring can be described.

These heterocyclic groups each may be substituted with an alkyl group such as a methyl group or ethyl group, an alkoxy group such as a methoxy group or ethoxy group, an aryl group such as a phenyl group, or a halogen atom such as a chlorine atom, bromine atom or fluorine atom.

A the lower alkyl group represented by $R^2$, an unsubstituted alkyl group having not more than 6 carbon atoms such as a methyl group, ethyl group, n-propyl group, iso-butyl group, or iso-amyl group, a hydroxyalkyl group such as a hydroxyethyl group, a cyanoalkyl group such as a cyanoethyl group, an aminoalkyl group such as a dimethylaminoethyl group can be described.

As the aryl group, a phenyl group, naphthyl group, p-tolyl group, p-chlorophenyl group can be described.

$R^2$ and $R^3$ may be form a heterocyclic ring by combining with together. As the heterocyclic ring thus formed, a morpholine ring, piperidine ring, piperadine ring and pyrrolidine ring can be described.

Concrete examples of the compound represented by Formula [I] are shown below.

S-1

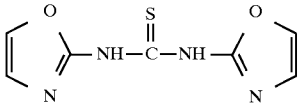

S-2

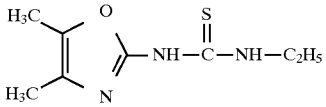

S-3

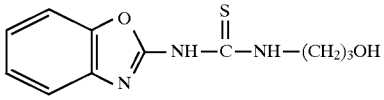

S-4

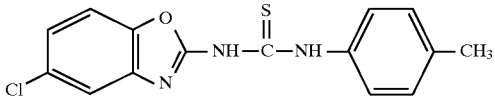

S-5

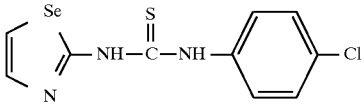

S-6

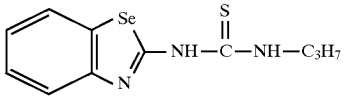

S-7

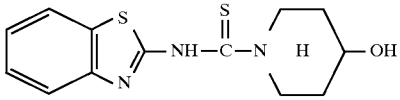

S-8

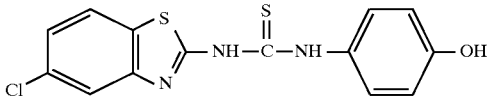

S-9

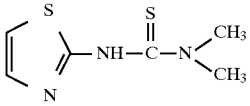

-continued

S-10

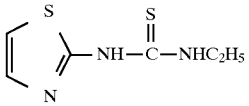

S-11

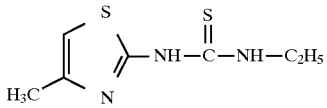

S-12

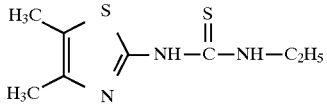

S-13

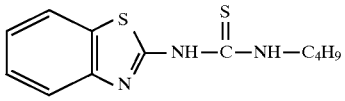

S-14

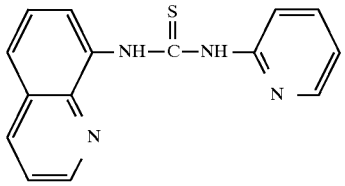

S-15

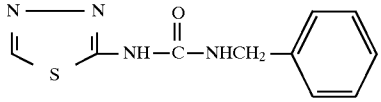

S-16

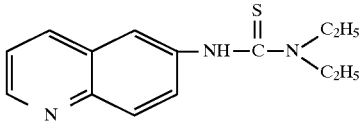

S-17

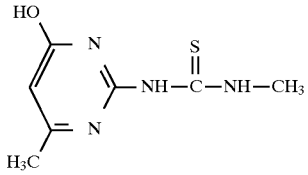

S-18

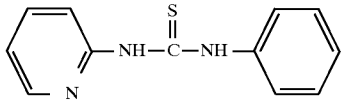

S-19

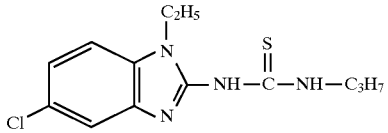

S-20

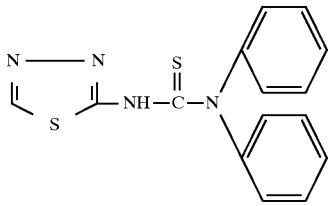

-continued

S-21

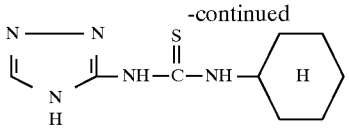

S-22

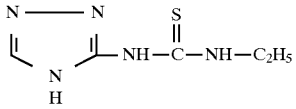

S-23

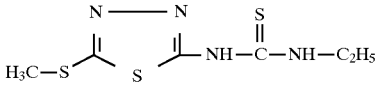

S-24

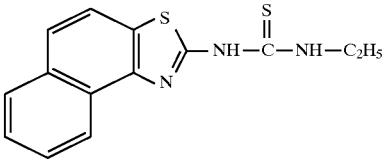

S-25

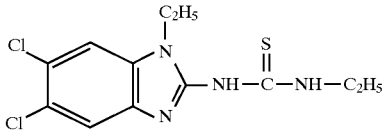

S-26

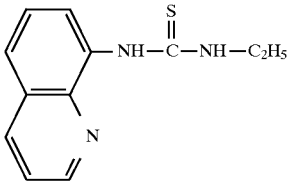

In the present invention, the sulfur sensitizer is added to a silver halide emulsion to be chemically sensitized in a form of dispersion of solid particles, hereinafter simply referred to solid dispersion. As the method for preparing the solid dispersion, various methods can be applied, which is usable for preparing fine particles dispersion of hardly soluble in water. For example a method in which the sulfur sensitizer is sufficiently mixed with a gelatin solution can be applied. Another method can be used, in which a sulfur sensitizer of the invention is dissolved in an organic low-boiling solvent capable of dissolving the sulfur sensitizer, and the solution thus obtained is dispersed and emulsified in the presence of a surfactant and is added to the emulsion. In this method it is preferred to remove the low-boiling organic solvent after dispersing step. Further, a method described in JP O.P.I. No. 4-140739/1992 can be applied, in which the sulfur sensitizer is added in a form of dispersion of a mixed solution with a polymer which is insoluble in water and soluble in an organic solvent. Another known method such as acid precipitation method, dispersion method by a ball-mill, jet-mill or impeller are also can be applied.

Although the average diameter of fine particles of sulfur sensitizer of the invention in the form of solid dispersion of solid may be took an arbitrary value, the average diameter is preferably 0.01 $\mu$m to 20 $\mu$m, more preferably 0.025 $\mu$m to 1 $\mu$m, further preferably 0.050 $\mu$m to 0.6 $\mu$m. The variation coefficient of the diameter of fine particles of the sulfur sensitizer of the invention in the form of the dispersion is preferably not more than 60%, more preferably not more than 40%.

The solid dispersion of the sulfur sensitizer according to the invention is added to the emulsion at any stage of the preparation process of the emulsion. The sulfur sensitizer is becomes effective as a chemical sensitizer when the conditions of the emulsion, such as temperature, $E_{Ag}$ and pH, are made to those suitable for chemical sensitization. In concrete, the sensitizer may be added at a period selected from the periods of before formation of silver halide grains, in the course of silver halide grain formation, between the completion of grain formation and starting of the desalting process, between completion of desalting and starting of the chemical sensitization, starting time of the chemical sensitization and during the chemical sensitization. Among them, the periods of between the completion of grain formation and starting of the desalting process, between completion of desalting and starting of the chemical sensitization, starting time of the chemical sensitization and during the chemical sensitization are preferable selected. It is most preferred to be add to the emulsion at the time of starting the chemical sensitization.

The adding amount of the sulfur sensitizer is in the form of solid dispersion is within the range of $1\times10^{-5}$ mg to 100 mg, preferably $1\times10^{-3}$ mg to 10 mg, per mol of silver halide, even though the optimum amount is changeable depending on the kind of silver halide and the expected degree of the effect of the sensitizer.

In the chemical sensitization according to the invention, a chemical sensitization with a noble metal sensitizer such as gold or platinum compound can be applied together with the sensitization by sulfur sensitizer in the form of solid dispersion of the invention in combination. As the examples of the noble metal sensitization, gold sensitization described in U.S. Pat. Nos. 2,540,085, 2,597,876, and 2,399,083, sensitization with ions of a metal of VIII group described in U.S. Pat. Nos. 2,448,060, 2,540,086, 2,566,245, 2,566,263 and 2,598,079 are cited. Further reduction sensitization described in, for example, U.S. Pat. Nos. 2,518,698, 2,419,974 and 2,983,610.

Further, the silver halide emulsion of the invention can be chemically sensitized by various kinds of chemical sensitizer together with the sulfur sensitizer in the solid dispersion of the invention.

As the chemical sensitizer, active gelatin, a sulfur sensitizer such as sodium thiosulfate, allylthiocarbamide, thiourea or allylisothiocyanate, a selenium sensitizer such as N.N-dimethylselenothiourea or thiourea, a reduction sensitizer such as triethylenetertamine or stannous chloride, noble metal sensitizer such as potassium chloroaurite, Potassium aurithiocyanate, potassium chloroaurate, 2-aurosulfobenzothiazole methylchloride, ammonium chloropalladate, potassium chloroplatinate or sodium chloropalladate are described. These sensitizer may be used solely or plurally.

When gold sensitizer is used, ammonium thiocyanate can be used as an aid.

In the light-sensitive material of the invention, it is preferred that a hydrazine compound is contained in a silver halide emulsion or a non-light-sensitive colloid layer adjacent to the emulsion layer to obtain an image having extreme high contrast. As the hydrazine compound used in the invention, ones represented by the following Formula [H] is preferably used.

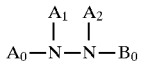

In the formula, $A_0$ is an aliphatic group, a aromatic group or a heterocyclic group. The aliphatic group represented by $A_0$ is preferably one having 1 to 30 carbon atoms, and is more preferably a straight- or branched-chain alkyl group having 1 to 20 carbon atoms, for example, a methyl group, ethyl group, t-butyl group, octyl group, cyclohexyl group and benzyl group. These groups may be substituted with an adequate substituent such as an aryl group, alkoxy group, aryloxy group, alkylthio group, arylthio group, sulfoxy group, sulfonamido group, sulfamoyl group, acylamino group or ureido group.

The aromatic group represented by $A_0$ in Formula [H] is preferably a single or condensed ring aryl group such as a benzene ring or naphthalene ring.

As the heterocyclic group represented by $A_0$, heterocyclic groups each including at least one hetero-atoms selected from atoms of nitrogen, sulfur and oxygen such as a pyrrolidine ring, imidazole ring, tetrahydrofuran ring, morpholine ring, pyridine ring, pyrimidine ring, quinoline ring, thiazole ring, benzothiazole ring, thiophene ring or furan ring.

The aryl group and heterocyclic group are particularly preferred as the group represented by $A_0$. It is preferred that the aryl group and heterocyclic group represented by $A_0$ each has a substituent. The preferred substituent includes an alkyl group, an aralkyl group, an alkenyl group, an alkynyl group, an alkoxy group, a substituted amino group, an acylamino group, a sulfonylamino group, a ureido group, a urethane group, an aryloxy group, a sulfamoyl group, a carbamoyl group, an alkylthio group, an arylthio group, sulfothio group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxyl group and a phosphoric amido group. These substituents each may further have a substituent. Among these substituents, ones having an acidic group having a pKa value of 7 to 11 such as a sulfonamido group, a hydroxyl group or a mercapto group, particularly a sulfonamido group, is preferred, when the light-sensitive material is processed by a developer having a pH value of not more than 10.5 for the total processing time (dry to dry) of not more than 60 seconds.

Further, it is preferred that the group represented by $A_0$ has at least one of a anti-diffusion group or a group accelerating adsorption to silver halide As the anti-diffusion group, a group usually used for ballast group of an immovable photographic additive such as a coupler is preferred. Groups each having 8 or more carbon atoms and being relatively inactive to photographic property such as an alkyl group, an alkenyl group, an alkynyl group, an alkoxy group, a phenyl group, a phenoxy group and an alkylphenyl group, can be described as the ballast group.

As the adsorption accelerating group, a residue of thiourea, a thiourethane group, a mercapto group, a thioether group, a thione group, a heterocyclic group, a thioamidoheterocyclic group, a mercaptoheterocyclic group and adsorption groups described in JP O.P.I. No, 64-90439/1989.

$B_0$ represents a blocking group which is preferably one represented by—$G_0$—$D_0$.

In the above, $G_0$ is a —CO— group, a —COCO— group, a —CS— group, a —C(=N$G_1D_1$)— group, an —SO— group, an —$SO_2$— group or a —P(O) ($G_1D_1$)— group, in which $G_1$ is a simple linking bond, an —O—, an —S— or an —N($D_1$) group; and $D_1$ is an aliphatic group, an aromatic group, a heterocyclic group or a hydrogen atom, and plural groups represented by $D_1$ may be the same or different when plural $D_1$ are present in the molecule.

$D_0$ is an aliphatic group, an aromatic group, a heterocyclic group, an amino group, an alkoxy group or a mercapto group.

As preferable $G_0$, a —CO— group and —COCO— group, particularly —COCO— group, are described.

As preferable $D_0$, a hydrogen atom, an alkoxy group and amino group are described.

$A_1$ and $A_2$ are each a hydrogen atom, or one of them is hydrogen atom and another one is an acyl group such as an acetyl, trifluoroacetyl or benzoyl, a sulfonyl group such as a methanesulfonyl group or toluenesulfonyl group or an oxaryl group such as an ethoxaryl group.

Concrete examples of compound represented by Formula [H] are shown below. The present invention is not limited thereto.

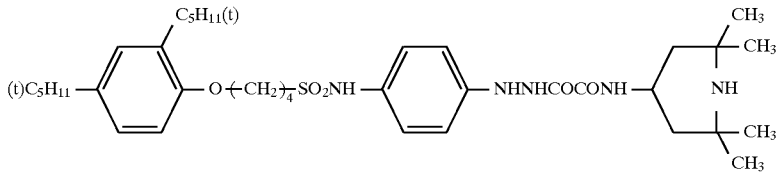

H-1

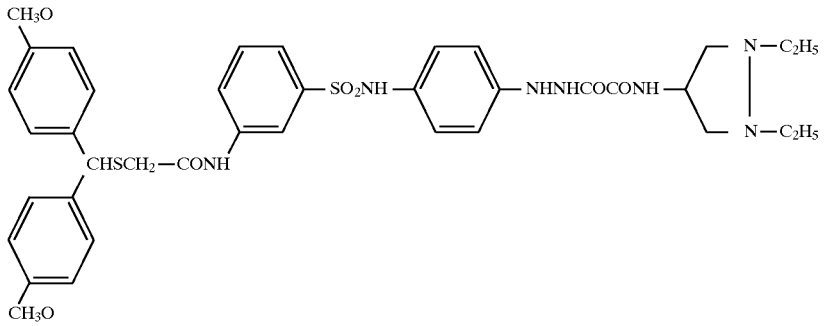

H-2

-continued
H-3
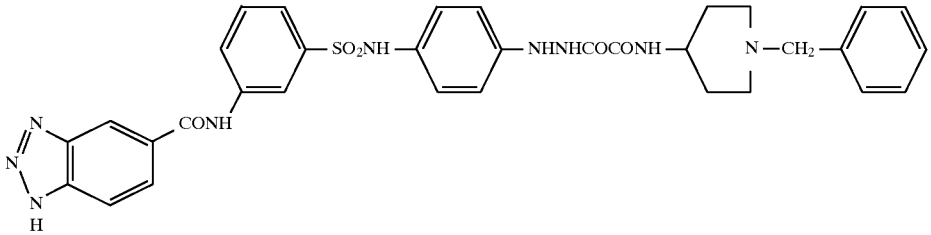
H-4
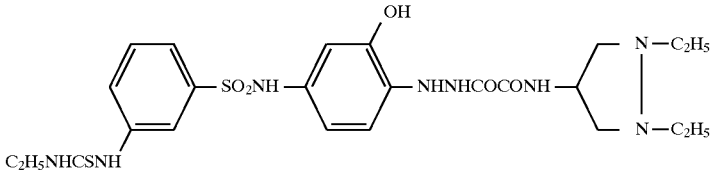
H-5
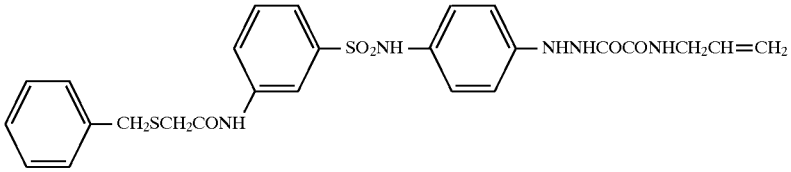
H-6
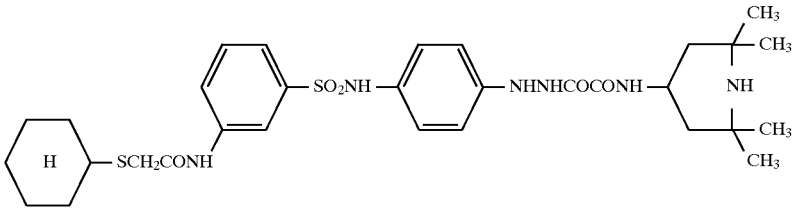
H-7
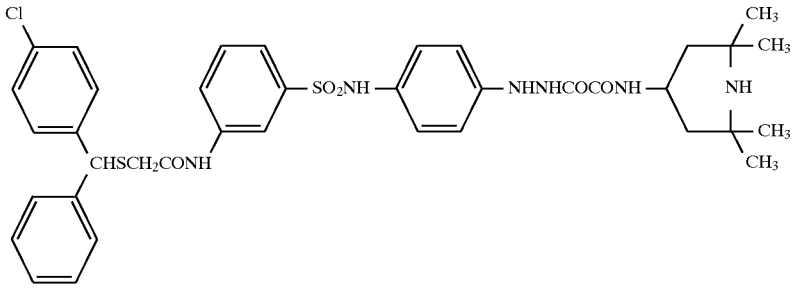
H-8
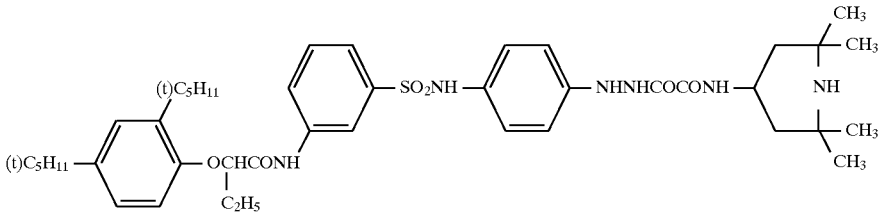
H-9
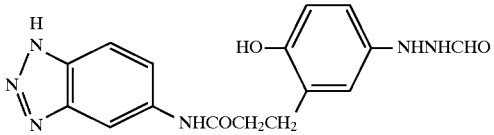
H-10
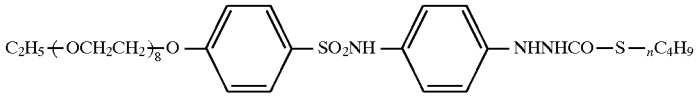

-continued
H-11
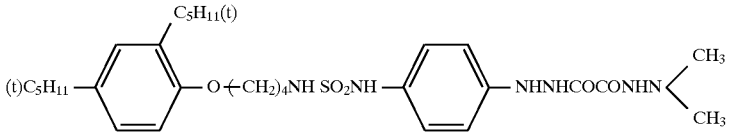
H-12
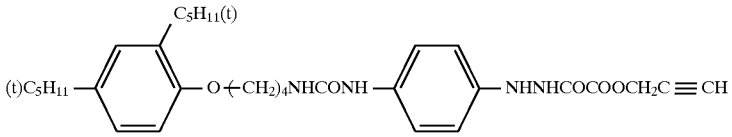
H-13
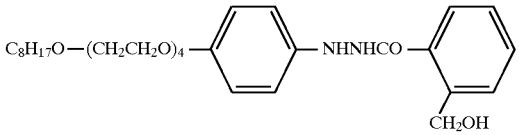
H-14
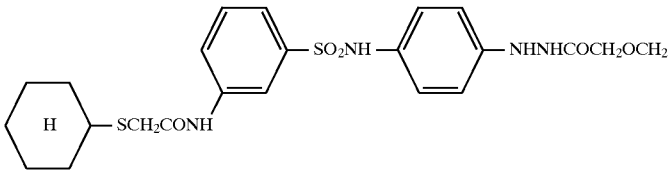
H-15
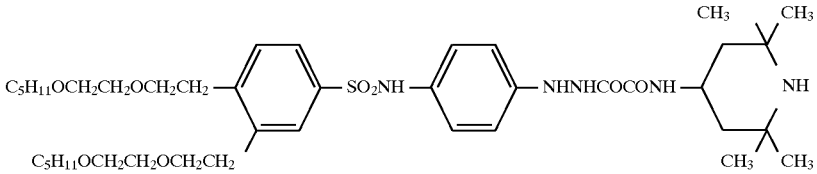
H-16
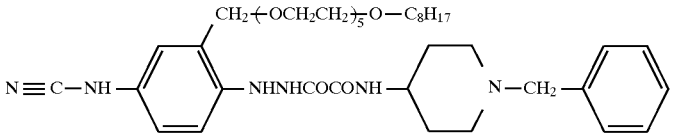
H-17
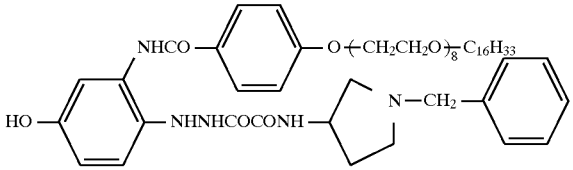
H-18
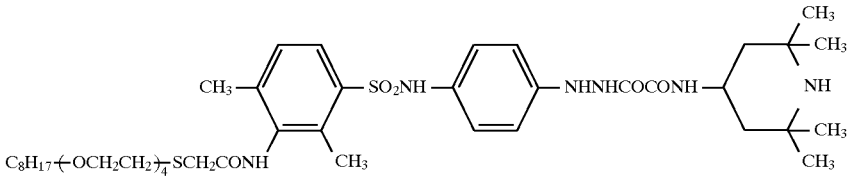
H-19
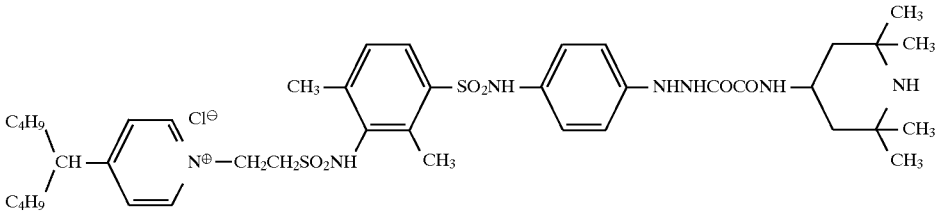

-continued

H-20

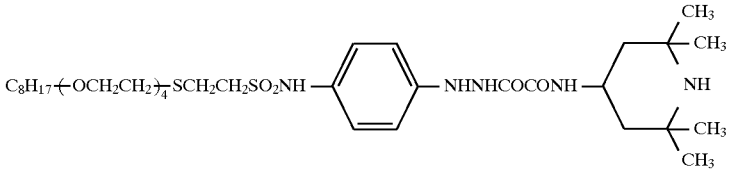

H-21

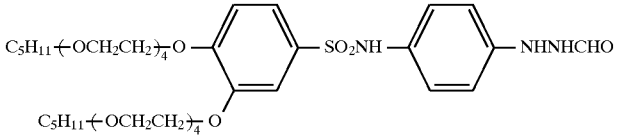

H-22

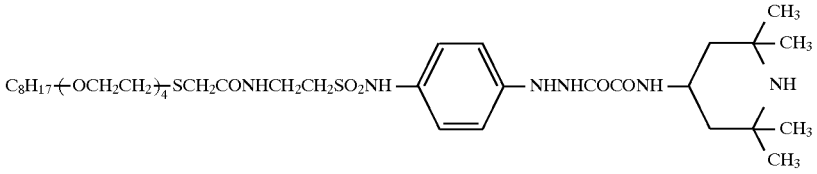

H-23

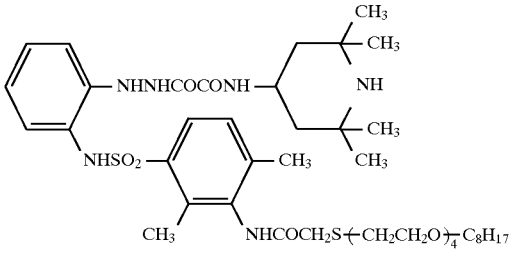

H-24

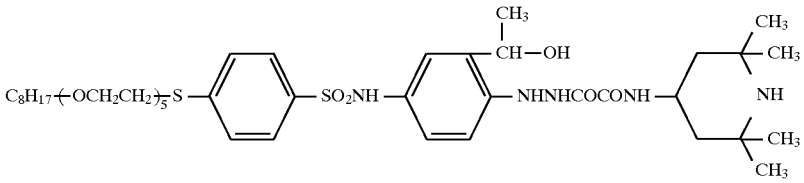

H-25

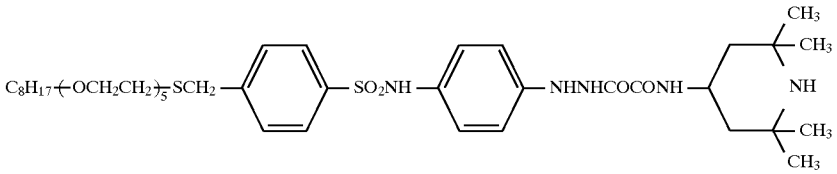

Although the hydrazine compound may be used, together with a known nucleation accelerating agent, in any layer provided on the emulsion layer coated side, the compound is preferably used in the silver halide emulsion layer or in an layer adjacent to the emulsion layer. The amount of the compound is preferably within the range of from $10^{-6}$ to $10^{-1}$ moles, particularly $10^{-5}$ to $10^{-2}$ moles per mole of silver halide even though the optimum amount of the compound is different depending on the grain size, halide composition, degree of chemical sensitization or kind of additive of the silver halide emulsion.

In the light-sensitive material of the invention, it is preferred that a silver halide emulsion or a non-light-sensitive hydrophilic colloid layer contains a redox compound capable of releasing a development inhibitor upon oxidation of the compound.

The redox compound has one of residues of hydroquinones, cathechols, naphthohydroquinones, aminophenols, pyrazolidones, hydrazines and reductones as a redox group. Preferable redox compounds are ones represented by the following Formula [II] or ones having a —NHNH— group as the redox group.

The redox compounds represented by Formula [II] are described below.

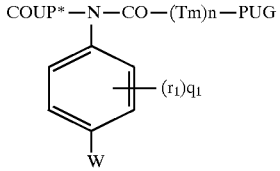

Formula [II]

* represent the coupling portion of coupler

In Formula [II], COUP represents a coupler residue capable of forming a coupling reaction with the oxidation product of an aromatic primary amine developing agent. Tm represents a timing group, PUG represents a development inhibitor and n is 0 or 1. W represents $N(R_{10})R_{11}$ or OH; $R_{10}$ and $R_{11}$ are each represent a hydrogen atom, an alkyl group, an aryl group or a heterocyclic group; $r_1$ represents a group substitutable to the benzene ring; and $q_1$ represents an integer of 0 to 4.

The coupler residues represented by COUP in Formula [II] include the followings. As cyan coupler residues, those of phenol couplers and naphthol couplers are described. As magenta coupler residues, those of 5-pyrazolone couplers, pyrazolone couplers, cyanoacetylcmarone couplers, open-chain acylacetonitril couplers and indazolone couplers are described. As yellow couplers, those of benzoylacetonitril couplers, pyvaloylacetonitril couplers and malondianilide couplers are described. As non-color-forming coupler residues, open-chain or cyclic active methylene compounds, for example, indanone, cyclopentanone, diester of malonic acid, imidazolinone, oxazolinone and thiazolinone, are described. Ones preferably usable in the invention among the coupler residues represented by Coup, can be represented by Formula (Coup-1) to Formula (Coup-8).

Formula (Coup-1)

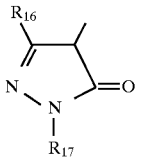

In the formula, $R_{16}$ represents an acylamido group, an anilino group or a ureido group; $R_{17}$ represents a phenyl group which may be substituted with one or more halogen atoms, alkyl groups, alkoxy groups or cyano groups.

Formula (Coup-2)

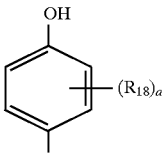

Formula (Coup-3)

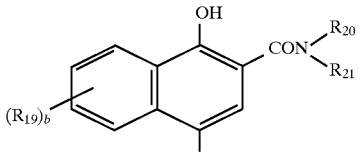

In the formulas, $R_{18}$ and $R_{19}$ each represent a halogen atom, an acylamido group, an alkoxycarbonyl group, a sulfoureido group, an alkoxy group, an alkylthio group, a hydroxyl group or an aliphatic group; $R_{20}$ and $R_{21}$ are each an aliphatic group, an aromatic group or a heterocyclic group. One of $R_{20}$ and $R_{21}$ may be a hydrogen atom, a represents an integer of 1 to 4; b represents an integer of 0 to 5. When a or b is plural, $R_{18}$'s and $R_{19}$'s may be the same or different, respectively.

Formula (Coup-4)

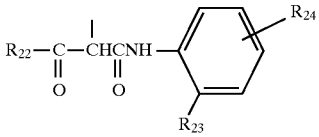

Formula (Coup-5)

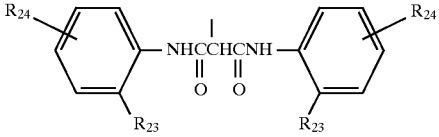

In the formulas, $R_{22}$ represents a tertiary alkyl group or an aromatic group; $R_{23}$ represents a hydrogen atom, a halogen atom or an alkoxy group. $R_{24}$ represents an acylamido group, an aliphatic group, an alkoxycarbonyl group, a sulfamoyl group, a carbamoyl group, an alkoxy group, a halogen atom or a sulfonamido group.

Formula (Coup-6)

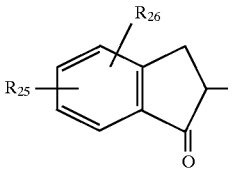

In the formula, $R_{25}$ represents an aliphatic group, an alkoxy group, an acylamino group, a sulfonamide group, a sulfamoyl group or a diacylamino group; and $R_{26}$ represents a hydrogen atom, a halogen atom or a nitro group.

Formula (Coup-7)

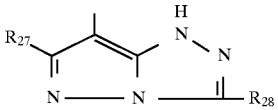

Formula (Coup-8)

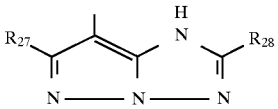

$R_{27}$ and $R_{28}$ represent each a hydrogen atom, an aliphatic group, an aromatic group or a heterocyclic group.

The timing group represented by Tm is preferably —$OCH_2$— or another di-valent timing group. As the timing group, ones described in, for example, U.S. Pat. Nos. 4,248,962, 4,409,323, and 3,674,478, Research Disclosure 21228 (December 1981), and JP O.P.I. Nos. 57-56837/1982 and 4-438/1992 can be described.

Preferable development inhibitors represented by PUG include ones described in, for example, U.S. Pat. No. 4,477,563, JP O.P.I. Nos. 60-218644/1985, 60-221750/1985, 60-233650/1985 and 61-11743/1986.

Concrete examples of compounds represented by Formula [II] usable in the invention are listed below. However, the invention is not limited thereto.

Tm-1

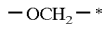

Tm-2

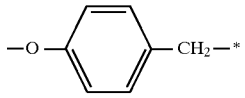

Tm-3

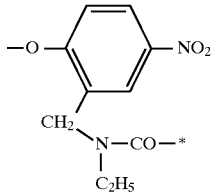

Tm-4

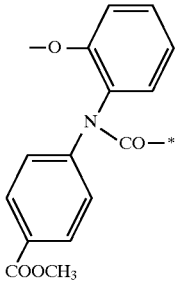

-continued
Tm-5
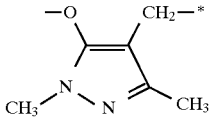
Tm-6
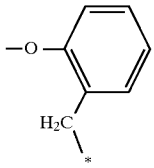
Tm-7
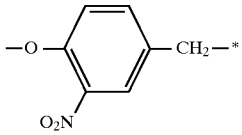
Tm-8
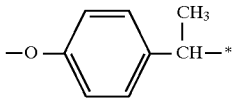
Tm-9
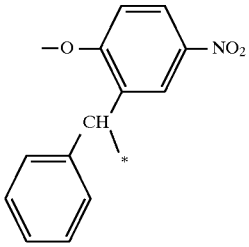
Tm-10
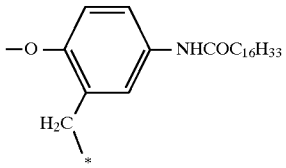
Tm-11
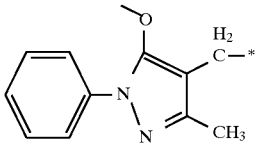
Tm-12
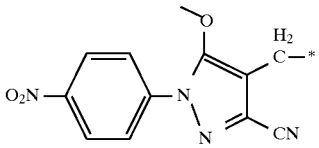
Tm-13
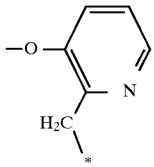
Tm-14
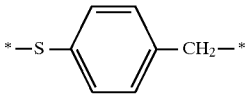
-continued
Tm-15
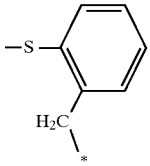
Tm-16
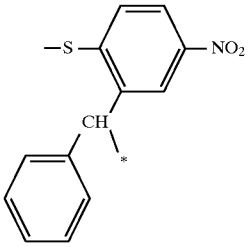
Tm-17
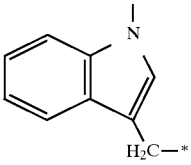
Tm-18
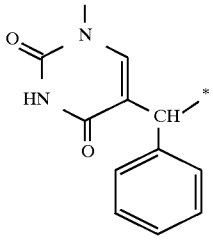
Tm-19
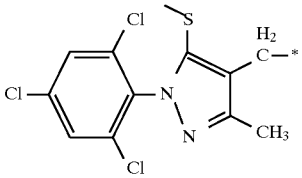
Tm-20
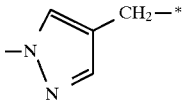
Tm-21
n = 0
*Bouding position of PUG
*—PUG
1
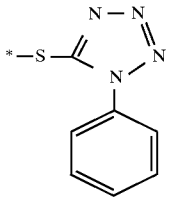
2
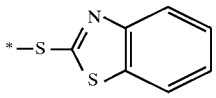

-continued
3 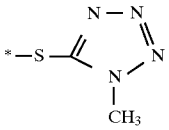
4 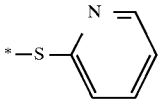
5 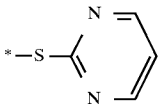
6 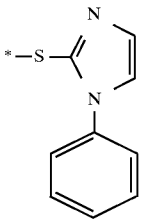
7 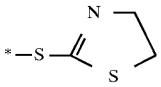
8 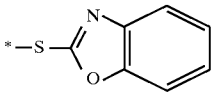
9 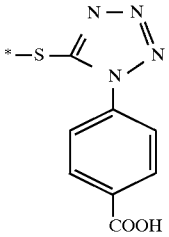
10 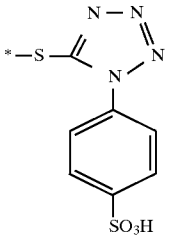
11 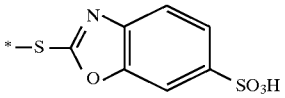
12 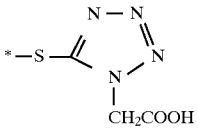
13 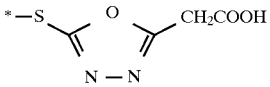
-continued
14 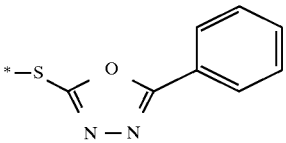
15 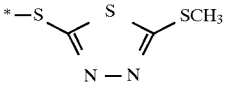
16 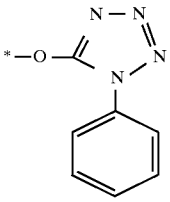
17 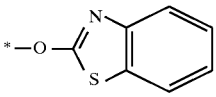
18 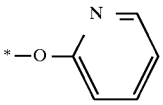
19 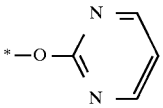
20 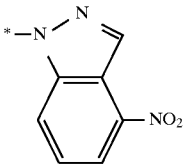
21 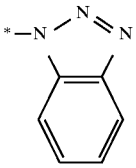
22 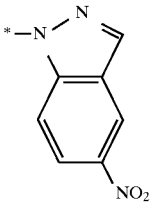
23 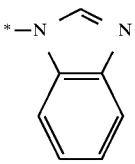

-continued
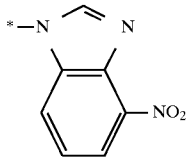
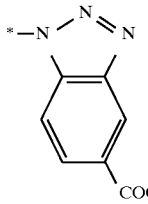
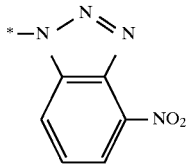
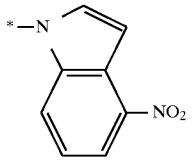
| Compound | Tm | PUG |
|---|---|---|
| 1 | 1 | 1 |
| 2 | 2 | 4 |
| 3 | 4 | 14 |
| 4 | 17 | 17 |
| 5 | 21 | 22 |
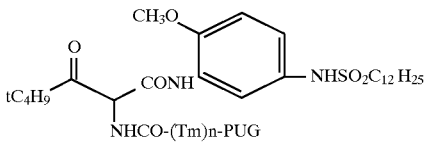
| | | |
|---|---|---|
| 6 | 2 | 2 |
| 7 | 3 | 6 |
| 8 | 6 | 10 |
| 9 | 11 | 13 |
| 10 | 20 | 24 |
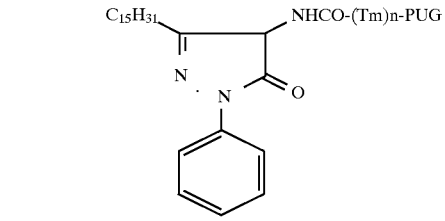
| | | |
|---|---|---|
| 11 | 1 | 1 |
| 12 | 2 | 5 |
| 13 | 5 | 2 |
| 14 | 6 | 15 |
| 15 | 17 | 3 |
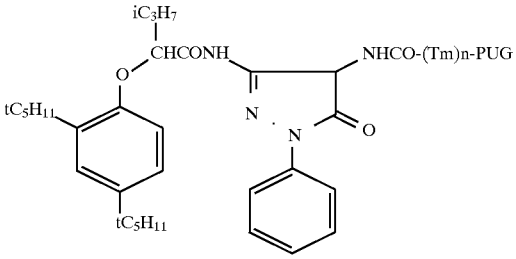
| | | |
|---|---|---|
| 16 | 1 | 1 |
| 17 | 2 | 1 |
| 18 | 2 | 4 |
| 19 | 2 | 5 |
| 20 | 6 | 2 |
| 21 | 8 | 5 |
| 22 | 8 | 1 |
| 23 | 18 | 22 |
| 24 | 20 | 2 |
| 25 | 21 | 20 |
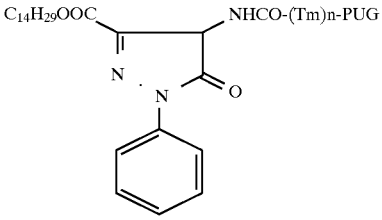
| | | |
|---|---|---|
| 26 | 2 | 4 |
| 27 | 4 | 8 |
| 28 | 12 | 9 |
| 29 | 13 | 12 |
| 30 | 16 | 16 |
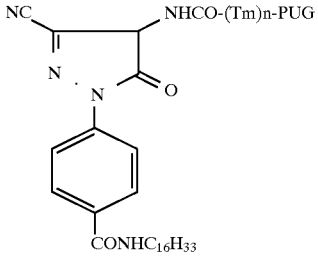
| | | |
|---|---|---|
| 31 | 2 | 3 |
| 32 | 7 | 7 |
| 33 | 8 | 11 |
| 34 | 14 | 14 |
| 35 | 19 | 18 |
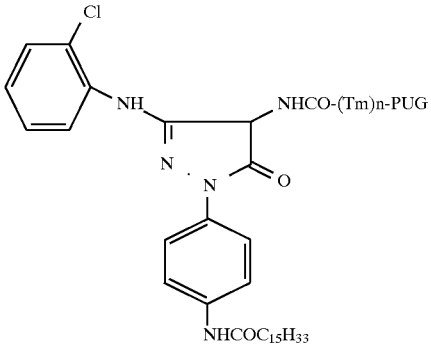
| | | |
|---|---|---|
| 36 | 2 | 2 |
| 37 | 5 | 8 |
| 38 | 9 | 18 |

-continued

| Compound | Tm | PUG |
|---|---|---|
| 39 | 10 | 21 |
| 40 | 19 | 27 |

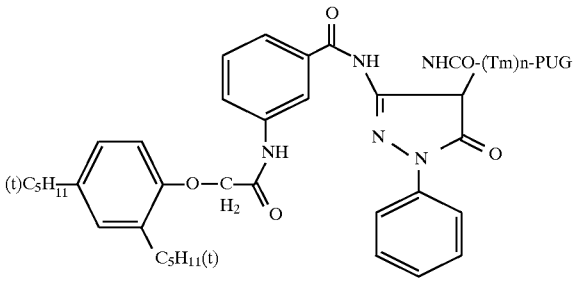

| | | |
|---|---|---|
| 41 | 2 | 4 |
| 42 | 2 | 5 |
| 43 | 5 | 15 |
| 44 | 6 | 6 |
| 45 | 21 | 26 |

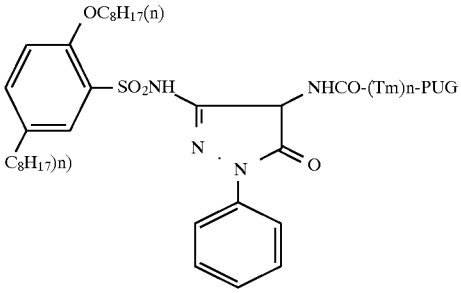

| | | |
|---|---|---|
| 101 | 2 | 4 |
| 102 | 8 | 5 |
| 103 | 8 | 1 |
| 104 | 1 | 15 |
| 105 | 17 | 18 |

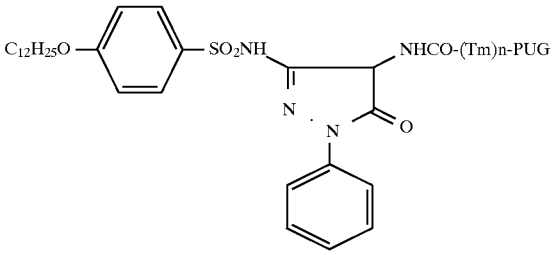

| | | |
|---|---|---|
| 106 | 2 | 4 |
| 107 | 8 | 5 |
| 108 | 8 | 1 |
| 109 | 1 | 20 |
| 110 | 14 | 23 |

It is preferred that the compound preferably usable in the invention represented by Formula II is contained in an amount of $1\times10^{-6}$ to $5\times10^{-2}$ moles, particularly $1\times10^{-4}$ moles to $2\times10^{-2}$ moles, per mole of silver halide.

The above-mentioned compounds represented by Formula [II] can be used as a solution dissolved in an appropriate water-miscible organic solvent such as alcohols, ketones, dimethylsulfoxide, dimethylformamide, and methyl cellosolve. The compound also can be added as an emulsified dispersion using a know oil. Further the compounds may be used as a dispersion of powder of the compound in water by dispersing the compound by a ball mill, colloid or impeller dispersing machine according to a method know as solid dispersion method.

The compounds having the —NHNH— group are represented by Formula [RE-a] or [RE-b].

Formula [RE-a]

T—NHNHCOV—(Tm)—PUG

Formula [RE-b]

T—NHNHCOCOV—(Tm)—PUG

In Formulas [RE-a] and [RE-b], T and V are each an aryl group or an alkyl group, the aryl and alkyl groups each may have a substituent. Tm and PUG are a timing group and a residue of development inhibitor the same as those in the above-mentioned Formula II.

As the aryl group represented by T and V, for example, a benzene ring and naphthalene ring are described, these groups each may substituted with various substituents. Preferable substituents include a strait- or branched-chain alkyl group, preferably one having 2 to 20 carbon atoms such as a methyl group, ethyl group, iso-propyl group and dodecyl group, an alkoxy group, preferably one having 2 to 21 carbon atoms such as a methoxy group and ethoxy group, an aliphatic acylamino group, preferably one having 2 to 21 carbon atoms such as acetylamino group and heptylamino group, and an aromatic acylamino group. The aromatic groups further include ones in which the above-mentioned substituted or unsubstituted aromatic rings are bonded by a bonding group such as —CONH—, —O—, —$SO_2$NH—, —NHCONH— or —$CH_2$CNH—. As a photographically usable group, 5-nitroindazole, 4-nitroindazole, 1-phenyltetrazole, 1-(3-sulfophenyl)tetrazole, 5-nitrobenzo-triazole, 4-nitrobenzotriazole, 5-nitroimidazole and 4-nitroimidazole can be described. These development inhibiting compounds are each linked to CO portion of T—NHNHCO— group directly through a hetero-atom such as N or S or through an alkylene group, a phenylene group, an aralkylene group or an arylene group and a hetero-atom such as N or S. Other than the above-mentioned, one formed by introducing a development inhibiting group such as triazole, indazole, imidazole, thiazole or thiadiazole to a hydroquinone compound having a ballast group cam be used. As such compound, for example, 2-(dodecylethyleneoxidepropionamido)-5-(5-nitoindazole-2-yl)hydroquinone, 2-stearylamido)-5-(1-ohenyltetrazole-5-thio)hydroquinone, 2-(2,4-di-t-amyl-phenoxypropionamido)-5-(5-nitrotriazole-2-yl)hydroquinone, 2-dodecyl-5-(2-mercaptothiothiazole-5-thio)hydroquinone can be described. The redox compound can be synthesized referring description of U.S. Pat. No. 4,269,929. The redox compound can be contained in an emulsion layer or a hydrophilic colloid layer adjacent to the emulsion layer, in such the case an interlayer may be provided between the emulsion layer and the hydrophilic colloid layer containing the redox compound.

The redox compound can be added after dissolved in an alcohol such as methanol or ethanol, a glycol such as ethylene glycol, triethylene glycol or propylene glycol, ether, dimetylformamide, dimethylsufoxide, tetrahydrofuran, an ester such as ethyl acetate, or a ketone such as acetone or methylethyl ketone. The redox compound may be arbitrarily dispersed to particles having an average diameter of 0.01 to 6 $\mu$m by means of a high speed impeller dispersion, a sand-mill dispersion, ultrasonic dispersion or ball mill dispersion when the redox compound is hardly dissolved in water or an organic solvent. The dispersion can be carried out by adding an anionic or nonionic surfactant, a thickener or a latex may be added for dispersion. The adding amount of the redox compound is preferably within the range of from $10^{-6}$ moles to $10^{-1}$ moles, more preferably $10^{-4}$ moles to $10^{-2}$ moles, per mole of silver halide.

Particularly preferred compound among ones represented by Formula [RE-a] or [RE-b] are shown below.

RE-1
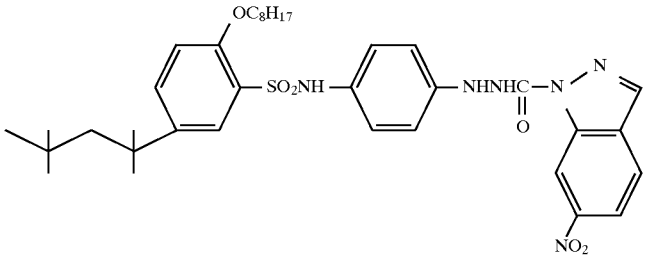
RE-2
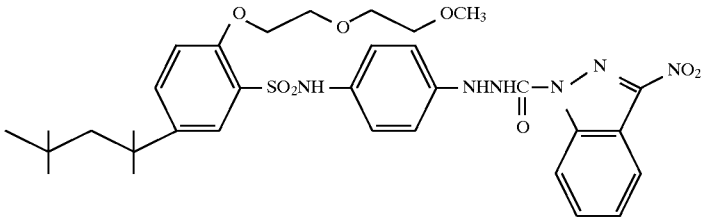
RE-3
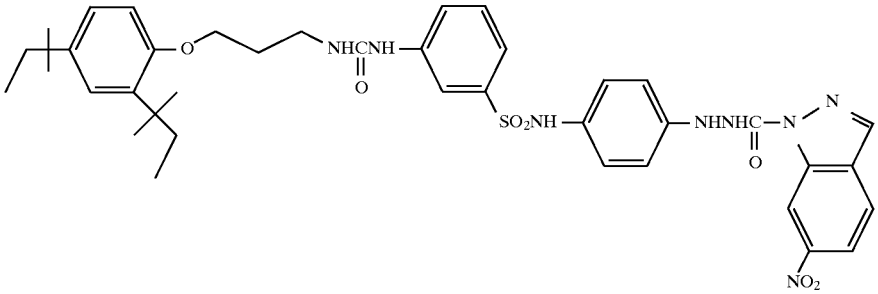
RE-4
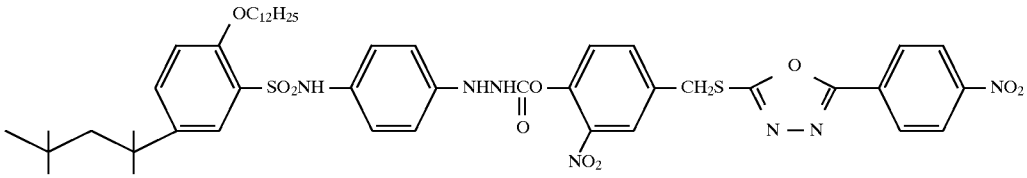
RE-5
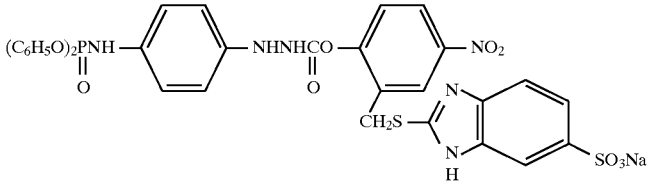
RE-6
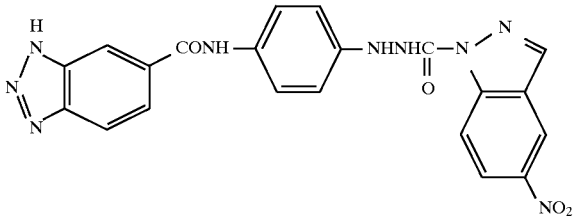

-continued

RE-7

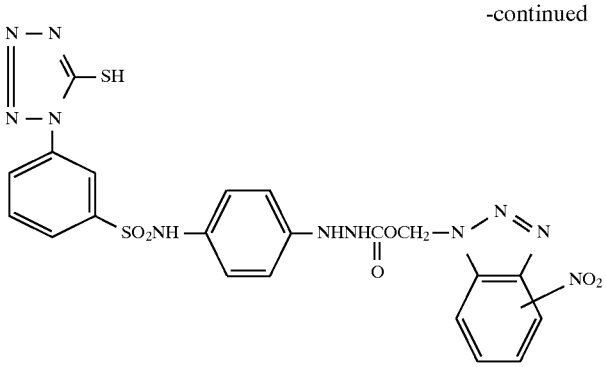

RE-8

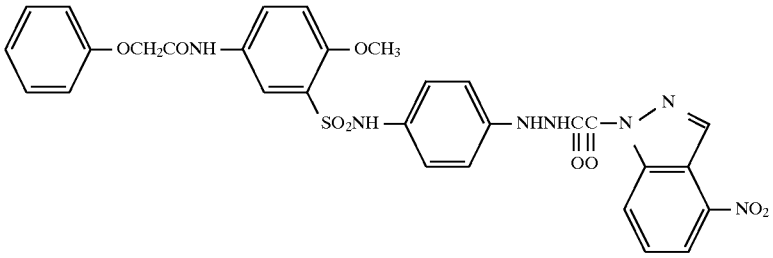

RE-9

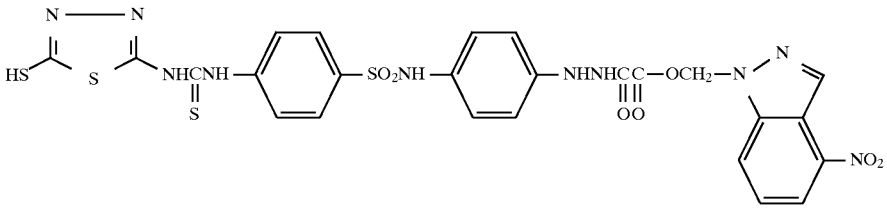

RE-10

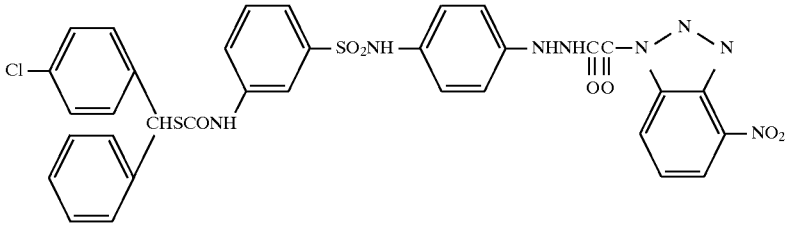

Concrete examples of preferable redox compounds other than the above are R-1 to R-50 described on page 236(8) [0053] to page 250(22) [0068] of JP O.P.I. No. 4-245243/1192.

In the present invention, the redox compound may be existed in a silver halide emulsion layer, a layer adjacent to the emulsion layer or another layer through the adjacent layer. It is particularly preferred that the redox compound is contained in the silver halide emulsion layer and/or a hydrophilic colloid layer adjacent to the emulsion layer. It is most preferable that the redox compound is contained in a hydrophilic colloid layer provided between a silver halide emulsion layer provided at the nearest portion to the support and the support. The redox compound may also be contained in plural layers different from each other.

Gelatin used in these layers can be hardened by means of a known cross-linking agent, and control of the molecular weight or use of cross-linking accelerator is preferably applied for separately making cross-link in each of the layers. A usually used amount of gelatin in each of the layers is preferably 0.1 g to 2.0 g per square meter. The cross-linking agent is preferably used in an amount of 0.01 milimoles to 1 milimole pre gram of gelatin.

Although various kinds of silver halide usually used in an ordinary silver halide emulsion such as silver bromide, silver iodobromide, silver iodochloride, silver chlorobromide and silver chloride can be used arbitrarily in the silver halide emulsion to be used in the invention, hereinafter referred to a silver halide emulsion or simply an emulsion, silver chlorobromide having a silver chloride content of not less than 50 mole-% and silver chloride are preferable.

The present invention is preferably applied to a silver halide grains for forming a negative image, in which the sensitivity at the grain surface is higher than that at the inner portion of the grain.

The average grain diameter of silver halide is preferably not more than 0.7 μm, more preferably 0.5 to 0.1 μm. The "average grain diameter" is a term usually used by skilled ones in the field of photographic science and is able to be easily understood by them. The term of "grain diameter" means the diameter of the grain when the grain has a spherical shape or a shape capable of approximating to a sphere. When the grain has a cubic shape, the grain is converted to a sphere and the diameter is defined as that of the sphere. With respect to the detail of the method for determining the average grain diameter, the description of C. E. Mees & T. H. James "The Theory of The Photographic Process, Vol. 3, p.p. 36–43, 1966, (Macmillan) can be referred.

There is no limitation on the shape of the silver halide grain, and any of grains each having a tabular, spherical, cubic, tetradecahedral or octahedral shape are usable. A narrower grain diameter distribution is preferred and a monodispersed emulsion is preferred, in which the number of grains having the diameter falling within the range of ±40% of the average grain diameter occupies 90%, particularly 95%, of the number of the whole number of the grains.

As the form to react a water-soluble silver salt with a water-soluble halide salt, any of a single-jet mixing method, a double-jet mixing method, and a combination thereof can be used. A method so called a reverse mixing method can also be used, in which grains are formed in the presence of excessive silver ions. An embodiment of the double-jet mixing method, termed controlled double-jet, can be used. In this method, pAg in the liquid phase in which silver halide grains are formed is maintained at a constant value. By this method, a silver halide emulsion comprising silver halide grains which have regular crystal shape and approximately uniform diameter can be obtained.

It is preferred to add a salt of cadmium, zinc, lead, thallium, rhodium, ruthenium, osmium or a complex salt containing the above element to at least one of the steps of forming or growing silver halide grains.

Description with respect to silver halide emulsion and preparation method thereof are described in detail in Research Disclosure No. 176, 17643, p.p. 22–23 (December 1978) or literature referred therein.

The silver halide emulsion of the invention may be spectrally sensitized at a desired wavelength by means of a sensitizing dye. Usable sensitizing dyes include cyanine dyes, merocyanine dyes, complex cyanine dyes, complex merocyanine dyes, holopolar cyanine dyes, hemicyanine dyes, styryl dyes and hemioxonol dyes. For these dyes, any of nuclei usually used in cyanine dyes as basic heterocyclic nuclei may be applied. Namely, nuclei of pyrroline, oxazoline, thiazoline, pyrrole, oxazole, thiazole, selenazole, imidazole tetrazole and pyridine; nuclei formed by condensing each of the above nuclei with an aliphacyclic hydrocarbon ring; and nuclei formed by condensing each of the above-mentioned nuclei with an aromatic hydrocarbon ring, such as nuclei of indolenine, benzindolenine, indole, benzoxazole, naphthoxazole, benzothiazole, naphthothiazole, benzoselenazole, benzimidazole and quinoline can be applied. These nuclei may have each a substituents on a carbon atom thereof. For merocyanine dyes and complex merocyanine dyes, 5- and 6-member heterocyclic ring such as nuclei of pyrazoline-5-one, thiohydantoin, 2-thiooxazolidine-2,4-dione, thiazolidine-2, 4-dione, rhodanine and thiobarbituric acid can be used as nuclei having ketomethylene structure. In concrete, ones described in Research Disclosure No. 176, RD-17643 (December 1978) P.P. 2–3, U.S. Pat. Nos. 4,425,425 and 4,425,426 can be used. The sensitizing dye may be dissolved by means of ultrasonic vibration in accordance with the description of U.S. Pat. No. 3,485,634. Further, as the method for dissolving or dispersing the sensitizing dye and adding it to an emulsion, those described in U.S. Pat. Nos. 3,482,981, 3,585,195, 3,469,987, 3,425,835 and 3,342,605, British Patent Nos. 1,127,329, 1,038,029 and 1,121,174, and U.S. Pat. Nos. 3,660,101, and 3,658,546 can be used. Although these sensitizing dyes may be used singly, they also may be used in combination, a combination of sensitizing dyes is frequently used for the purpose of supersensitization. Combinations of dyes giving effective supersensitization and substances having supersensitization effect are described in Research Disclosure No. 176, 17643, (December 1978) p. 23, Item IV-J.

In the light-sensitive material of the invention, various kinds of compounds may be contained for the purpose of preventing fogging or stabilizing the photographic properties of the light-sensitive material in the course of producing process or storage thereof. Various kinds of compounds known as fog inhibitor or stabilizer can be added. Examples of these compounds include azoles such as benzothiazolium salts, nitroindazoles, nitrobenzimidazoles, chlorobenzimidazoles, bromobenzimidazoles, mercaptothiazoles, mercaptobenzimidazoles, mercaptothiadiazoles, aminotriazoles, benztriazoles, nitrobenzotriazoles and mercaptotetrazoles, particularly 1-phenyl-5-mercaptotetrazole; mercaptopyrimidines, mercaptotriazines; thioketo compounds such as oxazolinethione; azaindenes such as triazaindenes, tetraazaindenes, particularly 4-hydroxy substituted-1,3,3a,7-tetraazainden, and pentaazaindenes; and benzenethiosulfonic acid, benzenesulfinic acid and benzenesulfonamide.

In the light-sensitive emulsion of the invention and a non-light-sensitive hydrophilic colloid, an inorganic or organic hardener may be contained. For example, chromium compounds such as chromium alum and chromium acetate, aldehydes such as formaldehyde, glyoxal and gultaraldehyde, N-methylol compounds such as dimethylol urea or methylol-dimethylhydantoin, dioxane derivatives such as 2,3-dihydroxydioxane, reactive vinyl compounds such as 1,3,5-triacryloyl-hexahydro-s-triazine, bis (vinylsulfonyl)-methylether or N,N'-methylene-bis[β-(vinylsulfonyl)-propionamide, reactive halogen compounds such as 2,4-dichloro-6-hydroxytriazine, mucohalogen acids such as mucochloric acid or phenoxymucochloric acid, iso-oxazoles, dialdehyde starch, 2-chloro-6-hydroxytriazinyl gelatin may be used singly or in combination.

In the emulsion layer and/or non-light-sensitive hydrophilic colloid layer of the invention, well known various surfactants may be contained for various purposes such as a coating aid, static charge prevention, lubricity improvement, dispersing agent, adhesion prevention and improvement in photographic properties.

Although it is advantageous to use gelatin as a binder or protective colloid of photographic emulsion, hydrophilic colloids other than gelatin can be used. Examples of usable hydrophilic colloid include gelatin derivatives, graft-polymers of gelatin with another high-molecular substance, proteins such as albumin and casein; cellulose derivatives such as hydroxyethyl cellulose, carboxymethyl cellulose and cellulose sulfate, sugar derivatives such as sodium arginate and starch derivative; and various kinds of synthetic hydrophilic high-molecular substance such as homo- or co-polymer of polymer polyvinyl alcohol, partially acetalized polyvinyl alcohol, poly-N-vinylpyrrolidone, polyacrylic acid, polymethacrylic acid, polyacrylamide, polyvinylimidazole, polyvinylpyrazole.

As gelatin, acid-processed gelatin can be use other than lime-processed gelatin, and a hydrolysis product and enzyme-decomposed product of gelatin also can be used.

In the photographic emulsion, a dispersion of water-insoluble or water hardly soluble synthetic polymer for the purpose of improvement in the dimension stability. As the polymer, for example, homo- or co-polymer composed of monomer unit of alkyl (metha)acrylate, alkoxyacryl (metha) acrylate, glysidyl (metha)acrylate, (metha)acrylamide, vinyl ester (such as vinyl acetate), acryloniril, olefin or styrene, or a combination thereof may be used. Further a co-polymer composed of a combination of the above-mentioned repeating unit and acrylic acid, methacrylic acid, α,β-unsaturated dicarboxylic acid, hydroxyalkyl (metha)acrylate, sulfoalkyl (metha)acrylate also can be used.

In the light-sensitive material, various kinds of additives, for example, a desensitizer, plasticizer, lubricant, development accelerator and oil, may be contained.

As the above-mentioned additives, ones described in Research Disclosure No. 176, p.p. 22–31 are usable.

In the light-sensitive material used in the invention, the emulsion layer and protective layer each may be a single layer or a laminated layer composed of two or more component layers. In the case of the laminated layer, an interlayer may be provided between the component layers.

In the light-sensitive material of the invention, the photographic emulsion layer and another layer are coated on one or both sides of an elastic support usually used in light-sensitive material. As the elastic support, a film composed of a synthetic high-molecular substance such as cellulose acetate, polystyrene or polyethylene terephthalate.

In the light-sensitive material of the invention, various kinds of dye may be contained for the purpose of raising the safety for safelight. In the invention, a layer containing the dye is preferably provided between the emulsion layer and the support. It is preferred that a first subbing layer is provided on the support and a second hydrophilic colloid layer containing the dye is provided on the first subbing layer. Although the amount of the dye is not specifically limited, it is preferred that the dye is added in an amount so as the effective transmission density of the layer to be made to 0.3 to 2. The coating amount of the dye-containing hydrophilic colloid layer is not less than 0.05 g/m$^2$ and less than 0.5 g/m$^2$, and preferably not less than 0.18 g/m$^2$ and less than 0.42 g/m$^2$.

The silver halide photographic light-sensitive material according to the invention is preferably processed by means of an automatic processor. The developer and fixer in the processor are each replenished while the processing is carried out. The replenishing amounts of the developer and the fixer are each proportional to the processed area of the light-sensitive material. The replenishing amounts of the developer and fixer is not more than 300 ml per m$^2$, preferably 75 to 200 ml per m$^2$, for reducing the amount of waste liquid.

It is preferred for satisfying the demand to reduce the processing time that the total processing time from the insertion of the front edge of the film into the processor to coming out from the drying zone of the processor or "dry to dry" is within the range of 10 to 60 seconds. Here, the "total processing time" includes all the time necessary for processing the silver halide photographic light-sensitive material. In concrete, the "total processing time" includes all time necessary for all process of, for example, development, fixation, bleaching, washing, stabilization and drying, namely, dry to dry. When the total processing time is less than 10 seconds, satisfactory photographic properties cannot be obtained by the reason of lowering in the sensitivity and contrast. More preferable total processing time, dry to dry, is 15 to 50 seconds.

The automatic processor includes one having a drying zone which has a heat conducting body heated at not less than 90° C., for example, a heating roller heated at 90° to 130° C., or a heat emission body heated at not less than 150° C., for example, one composed of tungsten, carbon, nichrom, zirconium oxide, yttrium oxide, thorium oxide through which electric current is directly applied so as to generate and emit heat or one composed of copper, stainless steel, nickel or various kinds of ceramics to which heating energy is transferred from a resistive heat generator so as to emit heat or infrared-ray.

As the developing agent in the invention, dihydroxybenzenes such as hydroquinone, chloro-hydroquinone, bromohydroquinone, 2,3-dichlorohydroquinone, methylhydroquinine, iso-propylhydroquinine and 2,5-dimetyl-hydroquinine, 3-pyrazolidones such as 1-phenyl-3-pyrazolidone, 1-phenyl-4-methyl-3-pyrazolidone, 1-phenyl-4,4'-dimethyl- 3-pyrazolidone, 1-phenyl-4-ethyl-3-pyrazolidone and 1-phenyl-5-methyl-3-pyrazolidone, aminophenols such as o-aminophenol, p-aminophenol, N-methyl-o-aminophenol, N-methyl-p-aminophenol and 2,4-diaminophenol, pyrogallol, ascorbic acid, 1-aryl-3-pyrazolines such as 1-(p-hydroxyophenyl)-3-aminopyrazoline, 1-(p-methylaminophenyl)-3-aminopyrazoline, 1-(p-aminophenyl)-3-aminopyrazoline and 1-(p-amino-N-methylphenyl)-3-aminopyrazoline, transition metal complex salts such as complex salts of a transition metal such as Ti, V, Cr, Mn, Co, Ni, or Cu, which is in a form having reducing ability to be used for the developer, for example, in a form of complex salt of $Ti^{+3}$, $V^{+2}$, $Cr^{+2}$ or $Fe^{+2}$, and as ligands thereof, aminocarboxylic acid such as ethylenediaminetetraacetic acid (EDTA) and diethylenetriaminepentaacetic acid (DTPA), phosphoric acids such as hexametapolyphosphoric acid and tetrapolyphosphoric acid) and salt thereof are described, are usable singly or in combination. As preferable combination of the developing agent, that of a 3-pyrazolidone and a dihydroxybenzene, that of an aminophenol and a dihydroxybenzene, that of a 3-pyrazolidone and ascorbic acid, an aminophenol and ascorbic acid, that of an aminophenol and a transition metal complex salt, and that of a 3-pyrazolidone and a transition metal complex salt, are described. The developing agent is preferably used in an amount of 0.01 to 1.4 moles per liter in usual.

In the invention, compounds described in Japanese examined Patent No. 62-4702/1987, JP O.P.I. Nos. 3-51844/1991, 4-26838/1992, 4-362942/1992 and 1-319031/1989 are cited as silver sludge preventing agents.

The waste liquid of the developer can be recovered by applying electric current. In concrete, a cathode, for example, an electric conductor or semiconductor such as stainless steel wool, is immersed in the waste liquid of developer and an anode, for example, an insoluble electric conductor such as carbon, gold, platinum or titanium, is immersed in a solution of an electrolyte and the tank of the waste liquid and the tank of the solution are contacted through an anion exchange membrane. The recovering is carried out by applying electric current between both of the electrodes. The light-sensitive material relating the invention can be processed while applying the electric current. At the time of recovering, various kinds of additives capable of adding to developer, for example, a preservative, alkaline agent, pH buffering agent, sensitizing agent, fog inhibitor or silver sludge preventing agent, can be supplementarily added to the developer. Further, in a method in which the light-sensitive material is processed while applying the electric current, the additives for developer can also be supplementarily added to the developer. When the developer is repeatedly used by recovering, the transition metal complex salt is preferred as the developing agent to be used in the developer.

Sulfite and metabisulfite to be used as a preservative in the invention include sodium sulfite, potassium sulfite, ammonium sulfite and sodium metabisulfite. The sulfite is preferably used in an amount of not less than 0.25 moles per liter, particularly preferably not less than 0.4 moles per liter.

To the developer, an alkaline agent such as sodium hydroxide or potassium hydroxide, a pH buffering agent such as carbonate, phosphate, borate, acetate, citrate or alkanolamine, a dissolution aid such as polyethylene glycols or ester thereof or alkanolamine, a sensitizer such as nonionic surfactants including polyoxyethylenes and quaternary ammonium compounds, a surfactant, a defoaming agent, an antifogant, for example, a halide salt such as potassium bromide or sodium bromide, nitrobenzindazole, nitrobenzimidazole, benzotriazole, benzothiazole, tetrazoles or thiazoles, a chelating agent such as ethylenediaminetetraacetic acid or alkali salts thereof, nitrilotriacetic acid or polyphsphates, a development accelerator such as compounds described in U.S. Pat. No. 2,304,025 and Japanese Examined Patent No. 47-45541, a hardener such as glutaraldehyde and bisulfite adduct thereof or a deforming agent can be added according to necessity. It is preferred to adjust the pH value of developer to 8.5 to 10.5 for making the total processing time to not more than 60 seconds.

The compound of the invention can be applied for an activator processing, a specific form of development, in which a light-sensitive material containing a developing agent in the emulsion layer, for example, is processed in an alkaline solution for development. Such the processing method is frequently applied as a method for rapidly processing a light-sensitive material together with a silver salt stabilizing treatment using a thiocyanate in combination. Such the processing solution can be applied to the light-sensitive material of the invention. The effect of the invention is enhanced in such the rapid processing.

As the fixing solution, one having an usual composition can be used. The fixing solution is usually an aqueous solution comprising a fixing agent and others and pH thereof is usually 3.8 to 5.8. As the fixing agent, thiosulfates such as sodium thiosulfate, potassium thiosulfate and ammonium thiosulfate, thiocyanates such as sodium thiocyanate, potassium thiocyanate and ammonium thiocyanate, and other organic sulfur compounds each capable of forming a water soluble stable silver complex salt known as fixing agents can be used.

In the fixing solution a water soluble aluminum salt effective as hardener such as aluminum chloride, aluminum sulfate or potassium alum can be added. In the fixing solution, a preservative (such as sulfite or bisulfite), pH buffering agent (such as acetic acid), a pH controlling agent (such as sulfuric acid), and a chelating agent having a water softening ability may be contained according to necessity. The fixing solution may be a mixture of solids components, an organic aqueous solution containing glycol or amine or one in a form of high viscous past. The composition ma be used after dilution at the time of the use or without dilution.

The developing temperature may be set within ordinary temperature range of 20° to 30° C., or within high temperature processing range of 30° to 40° C., when the developing process of the invention is carried out.

EXAMPLES

Concrete examples of the embodiment of the invention are described below. However, the embodiment of the invention is not limited thereto.

Example 1

(Preparation of support having a conductive layer)

A subbed 100 μm thick polyethylene terephthalate is subjected to corona discharge, and a antistatic solution having the following composition was coated by a roll-fit coating pan and an air knife with a speed 70 m/min so that the coating amount to be the followings.

| | |
|---|---|
| Water-soluble conductive polymer P-6 | 0.6 g/m$^2$ |
| Hydrophobic polymer particle L-1 | 0.4 g/m$^2$ |
| Polyethyleneoxide compound Ao-1 | 0.06 g/m$^2$ |
| Hardener E-8 | 0.2 g/m$^2$ |

The coated matter was dried at 90° C. for 2 minutes and was subjected to heating treatment at 140° C. for 90 minutes. Thus a support having a conductive layer on one side thereof was prepared.

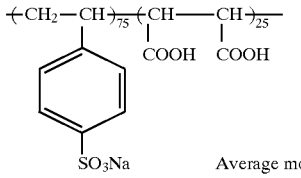

P-6

Average molecular weight (Mw) 70,000

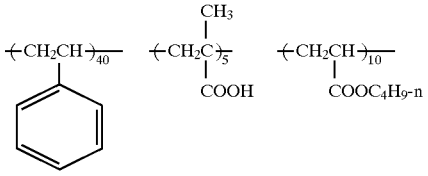

L-1

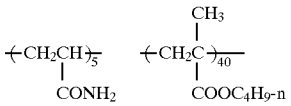

$HO(CH_2CH_2O)nH$ [n = 15] Ao-1

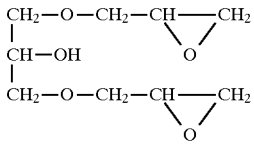

E-8

(Preparation of silver halide emulsion)

A silver chloroiodobromide emulsion (70 mole-% of silver chloride, 0.2 mole-% of silver iodide and the remainder of silver bromide) was prepared by a double-jet method.

Potassium bromorhodate and potassium chloroosmate were added each in an amount of $8\times10^{-8}$ moles per mole of silver while the course of mixing process from the time at which the average diameter of grains was attained 5% of the diameter to be finally attained to the time at which the average grain diameter was attained to the final value.

Thus obtained emulsion was desalted by an ordinary flocculation method using a modified gelatin treated with phenylioscyanate, and the following compound [A], [B] and [C] were added in the total amount of 8 mg per gram of gelatin to the emulsion as anti-mold agents. Thus an emulsion comprised of cubic monodispersed (variation coefficient: 10%) grains having an average diameter of 0.30 μm) was obtained.

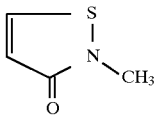

[A]

-continued

[B]

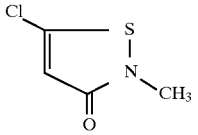

[C]

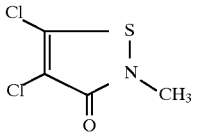

[A]:[B]:[C]=46:50:4 (in mole ratio)

Citric acid and potassium bromide were added to the emulsion so as the values of pH and $E_{Ag}$ of the emulsion to be 5.6 and 123 mV, respectively. Then $2\times10^{-5}$ moles per mole of silver of chloroauric acid and 0.6 mg per mole of silver of elemental sulfur or sulfur compound shown in table 1 were added to the emulsion, and the emulsion was chemically ripened at 55° C. for 80 minutes. Then 4-hydroxy-6-methyl 1,3,3a,7-tetraazaindene in an amount of 1 g per mole of silver to the emulsion to stop the ripening and 50 mg per mole of silver of potassium iodide and 150 mg per mole of silver of sensitizing dye SD-1 having the following structure were added to obtain silver halide Emulsions 1 through 4.

TABLE 1

| Emulsion No. | Sulfur compound | Adding method | Note |
|---|---|---|---|
| 1 | Inorganic sulfur | Dissolved in methanol (0.01%) | Comparative |
| 2 | Inorganic sulfur | Powdered to average particle size of 0.5 μm using zilconia beads | Inventive |
| 3 | S-10 | Dissolved in methanol (0.01%) | Comparative |
| 4 | S-10 | Powdered to average particle size of 0.5 μm using zilconia beads. | Inventive |

(preparation of coating solution of emulsion)

To the above emulsion, 4 g of hydroquinone, 15 g of the following latex P-1, 150 mg of inhibitor ST-1, 2 g of styrene/maleic acid copolymer (Mw=70000) 10 ml of 1N sodium de solution and 1.5 g of the following SA-1 were each added per mole of silver. Further a coating aid of saponine and 10 mg per gram of gelatin of a hardener of 2,4-dichloro-6-hydroxy-1,3,5-triazine sodium salt were added.

(Preparation of coating solution of emulsion protective layer)

The following solution was prepared. The amount of the components of the solution are described in terms of those to be coated to 1 $m^2$ of the sample. To an aqueous solution containing 1.1 g of gelatin, 1 mg of formalin adduct of sodium bisulfite, 5.5 mg of 1-phenyl-4-hydroxy-methyl-3-pyrazolidone, 15 mg of each of 2 kind of monodispersed silica dispersions each having average particle diameter of 3 μm and 8 μm, 7 mg of the following SA-2 as a coating aid, 2 mg of citric acid and 20 mg of formalin as a hardener were added. Further, fluorine-containing surfactant FA-33 was added as a coating aid in an amount of so as to be $3\times10^{-6}$ moles per $m^2$.

(Preparation of coating solution of backing layer)

The following solution was prepared. The amounts of the component are each described in terms of those to be coated to 1 $m^2$ of the sample. To an aqueous solution containing 2.3 g of gelatin, 100 mg of the following water-soluble dye compound-1, 25 mg of dye compound-2 and 100 mg of dye compound-3, 350 mg of polymer latex P-1, 60 mg of styrene/maleic acid copolymer (Mw=70000), 150 mg of colloidal silica, 20 mg of the mixture of [A], [B] and [C], 9 mg of dodecylbenzenesulfonic acid as a coating aid, and 9 mg of glyoxal and 55 mg of 2,4-dichloro- 6-hydroxy-1,3,5-triazine sodium salt as hardeners were added and stirred.

SA-2

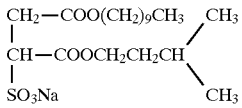

SD-1

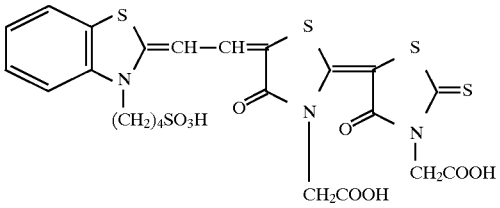

P-1

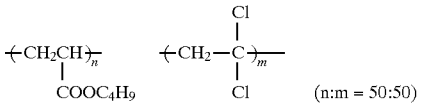

ST-1

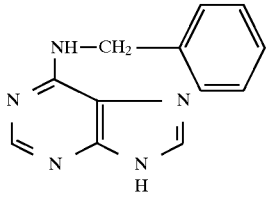

SA-1

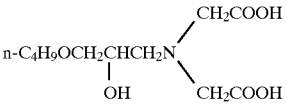

FA-33

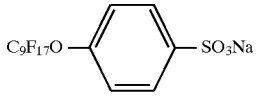

Dye compound-1

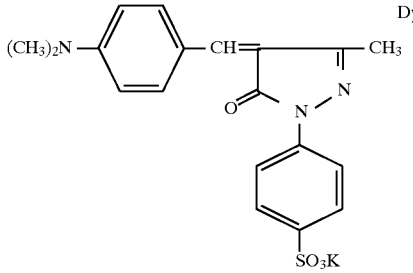

Dye compound-2

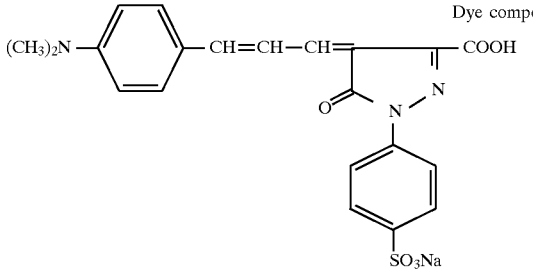

-continued

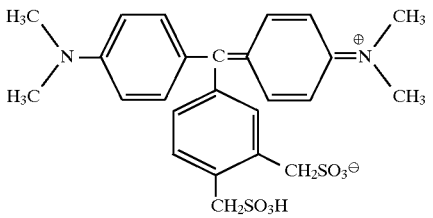

Dye compound-3

(Preparation of coating solution of backing protective layer)

The following solution was prepared. The amounts of components of the solution are described in terms of those to be coated to $m^2$ of the sample. To an aqueous solution containing 0.7 g of gelatin, 7 mg of SA-2, a monodispersed dispersion of polymethyl methacrylate having an average particle size of 5.5 $\mu$m, 20 mg of the mixture of [A], [B] and [C], 40 mg of styrene/maleic acid copolymer (Mw=70000) were added and stirred. Further glyoxal and 10 mg of 2,4-dichloro-6-hydroxy-1,3,5-triazine sodium salt were added as hardeners.

(Preparation of sample)

On the antistatic layer coated side of the foregoing polyethylene terephthalate film support having an antistatic layer was subjected to corona discharge with energy of 15 W/($m^2$·min) and the above-prepared backing layer coating solution and backing protective layer were coated thereon. The other side of the support was subjected to corona discharge with energy of 15 W/($m^2$·min) and an emulsion layer and a protective layer were coated and dried. The coating was carried out so that the amounts of silver and gelatin were to be 3.2 g/$m^2$ and 1.7 g/$m^2$, respectively, for each of Emulsions 1 to 4. Thus Samples 1 through 4 were prepared. The samples thus obtained were each contacted with an optical step-wedge and exposed to light of 633 nm as simulation of He-Ne laser light. Then the samples were process by means of an automatic processor for rapid processing (GR-26SR, manufactured by Konica Corporation) using the following developer and fixing solution.

<Processing condition>

[Receipt of developer]

| | |
|---|---|
| Pentasodium diethyltriaminepentaacetate | 1 g/l |
| Sodium sulfite | 42.5 g/l |
| Hydroquinone | 20 g/l |
| 4-ethyl-4-hydroxymethyl-1-phenyl-3-pyrazolidone | 0.85 g/l |
| potassium carbonate | 55 g/l |
| Benzotriazole | 0.2 g/l |
| Potassium bromide | 4 g/l |
| Boric acid | 8 g/l |
| Diethylene glycol | 40 g/l |
| 1-phenyl-6-mercaptotetrazole | 0.03 g/l |
| Potassium hydroxide | 17.5 g/l |
| 8-mercapto adenine | 0.078 g/l |
| Add water and potassium hydroxide to make 11 and pH 10.4 | |

(Composition of fixing solution)

| | |
|---|---|
| Ammonium thiosulfate (70% aqueous solution) | 200 ml/l |
| Sodium sulfite | 22 g/l |
| Boric acid | 9.8 g/l |
| Sodium acetate trihydrate | 70 g/l |
| Acetic acid (90% aqueous solution) | 14.5 g/l |
| Tartaric acid | 3 g/l |
| Aluminum sulfate (27% aqueous solution) | 25 ml/l |
| Adjust pH value to 4.9 using sulfuric acid | |

(Processing condition)

| (Process) | (Temperature) | (Time) |
|---|---|---|
| Developing | 38° C. | 12 sec. |
| Fixing | 35° C. | 10 sec. |
| Washing | 40° C. | 10 sec. |
| Drying | 50° C. | 12 sec. |
| Total | | 44 sec. |

(Evaluation of sensitivity and gamma)

The processed sample was determined by PDA-65 (digital densitometer manufacture by Konica Corporation). In the table, the sensitivity is represented in terms of a relative value when the sensitivity of Sample 1 is set 100. The gamma is represented by tangent of density 0.1 and 3.0. One showing a gamma value in the table of less than 7 is unacceptable for practical use, and a value of within the range of 0.7 to less than 10 is still not sufficient. A gamma value of not less than 10 shows that a ultra-hard contrast image can be obtained and the light-sensitive material is sufficiently acceptable for practical use.

(Evaluation of aging property)

The samples storage for 3 days under an environment of 50° C. and 50% RH for simulation of aging are compared with samples stored in a freezer. The results are shown in Table 2.

TABLE 2

| Sample No. | Emulsion No. | Without storage Sen. | Gamma | Fog | Stored for 3 days at 50° C. and 50% RH Sen. | Gamma | Fog | Note |
|---|---|---|---|---|---|---|---|---|
| 1 | 1 | 100 | 8.5 | 0.035 | 150 | 5.5 | 0.15 | Comp. |
| 2 | 2 | 120 | 13.3 | 0.022 | 129 | 12.3 | 0.030 | Inv. |
| 3 | 3 | 105 | 9.5 | 0.038 | 159 | 6.5 | 0.15 | Comp. |
| 4 | 4 | 123 | 12.5 | 0.027 | 134 | 11.8 | 0.037 | Inv. |

It is proved by the results in Table 2 that the samples of the invention are higher in the sensitivity and contrast and lower in the fog. Further it is proved from the evaluation simulating storage that the samples of the invention are stable because the sensitivity change and increasing in the fogging during the storage are also small.

Example 2

(Preparation of silver halide emulsions A1 and A3)

Core silver halide grains composed of 95 mole-% of silver chloride and the remainder of silver bromide were prepared by a double-jet method. In the course of mixing of the core grains, $8\times10^{-8}$ moles per mole of silver of $K_3Rh(NO)_4(H_2O)_2$ and $8\times10^{-6}$ moles per mole of silver of $K_3OsCl_6$ were added. A shell was added to each of the core particles by a double-jet method. At this time, $3\times10^{-7}$ moles per mol of silver of $K_2IrCl_6$ was added. Then KI conversion by means of silver iodide fine particles was applied. Thus obtained emulsion was a core/shell type monodispersed (variation coefficient: 10%) emulsion comprising cubic crystal of silver chloroiodobromide (90 mole-% of silver chloride, 0.2 mole-% of silver iodobromide and the remainder of silver bromide) having an average grain diameter of 0.2 $\mu$m. The emulsion was desalted using a modified gelatin described in JP O.P.I. No. 2-280139/1990 (gelatin (G-8)

described in JP O.P.I. No. 2-280139/1990, in which amino groups were substituted by phenylcarbamoyl). The $E_{Ag}$ of the emulsion after desalting was 190 mV at 50° C.

To the emulsion, potassium bromide and citric acid were added to adjust the values of pH and $E_{Ag}$ to 5.6 and 123 mV, respectively, and $2\times1^{-5}$ moles per mole of silver of chloroauric acid and $2\times1^{-5}$ moles per mole of silver of 0.01% methanol solution of inorganic sulfur were further added. The emulsion was maintained at 60° C. To the emulsion, $2\times10^{-3}$ moles per mole of silver of 4-hydroxy-6-methyl-1, 3,3a,7-tetraazaindene, $3\times10^{-4}$ moles per mole silver of 1-phenyl-5-mercaptotetrazole and gelatin were added 80 minutes after the addition of chloroauric acid, and 300 mg per mole of potassium iodide was further added to obtain Emulsion A1. Emulsion A3 was obtained in the same manner as in Emulsion A1 except that $2\times10^{-5}$ moles per mole silver of inorganic sulfur which was powdered by means of zirconia beads so that the average diameter was made to be 0.5 μm, was added in place of 0.01% methanol solution.

(Preparation of silver halide emulsions A2 and A4)

Emulsion A2 was prepared in the same manner as in Emulsion A1 except that the amount of the rhodium complex salt was changed to $9\times10^{-8}$ moles per mole of silver. Emulsion A4 was prepared in the same manner as in Emulsion A3 except that the amount of the rhodium complex salt was changed to $9\times10^{-8}$ moles per mole of silver.

(Preparation of silver halide emulsions A5 through A8)

Emulsions A5 and A6 were prepared in the same manner as in Emulsions A3 and A4, respectively, except that the elemental sulfur dispersion was replaced by a elemental sulfur having an average particle diameter of 0.5 μm prepared by mixing a methanol solution of elemental sulfur with water. Emulsions A7 and A8 were prepared in the same manner as in Emulsions A3 and A4, respectively, except that the elemental sulfur dispersion was replaced by a elemental sulfur having an average particle diameter of 0.3 μm prepared by mixing a methanol solution of elemental sulfur with water. In the above, the amounts of elemental sulfur used in Emulsions A5 to A8 were each $2\times10^{-5}$ moles per mole of silver.

(Preparation of silver halide photographic material for scanner for graphic art)

On a support, a gelatin subbing layer according to the following Receipt 1 in an amount of 0.5 g/m$^2$ in terms of gelatin; a silver halide emulsion layer 1 according to Receipt 2 in an amount of 1.5 g/m$^2$ and 1.0 g/m$^2$ each in terms of silver and gelatin, respectively; a coating solution according to Receipt 3 to form an interlayer in an amount 0.3 g/m$^2$ in terms of gelatin; a silver halide emulsion layer 2 according to Receipt 4 in an amount of 1.5 g/m$^2$ and 0.1 g/m$^2$ each in terms of silver and gelatin, respectively; and a coating solution according to Receipt 5 in an amount 0.6 g/m$^2$ in terms of gelatin were simultaneously coated in the above order from the support. On the subbing layer of the other side of the support, a backing layer according to Receipt 6 in an amount of 0.6 g/m$^2$ in terms of gelatin; a polymer layer according to Receipt 7; and a backing protective layer according to Receipt 8 in an amount of 0.4 g/m$^2$ in terms of gelatin; were coated simultaneously with a coating speed of 200 m/min. The coating was carried out with the coating of the layers of the emulsion layer side at the same time. Thus Sample No. 5 of silver halide photographic light-sensitive material was obtained. Sample No. 6 was prepared in the same manner as in sample 5 except that the redox compound was replaced by one described in Table 3. Further, Sample Nos. 7 through 11 were prepared in the same manner as in Sample No. 5 except that the silver halide emulsion A2 in Receipt 2 was replace by Emulsion A4, the redox compound was replaced by ones described in Table 3 and silver halide emulsion A1 in Receipt 4 was replaced by Emulsion A3. On the other hand, Samples 12 and 13 were prepared in the same manner as in Sample No. 7 except that Emulsions A4 and A3 were replaced by Emulsions A6 and A5, respectively, in Sample No. 12, and Emulsions A4 and A3 were replaced by Emulsions A8 and A7, respectively, in Sample No. 13. In the followings, the numbers represent the coating amounts per square meter, the coating amount of silver halide emulsion was represented in terms of silver and the amount of component to be added in a small amount was represented in terms of moles per mole of silver.

| Receipt 1 (Composition of gelatin subbing layer) | |
|---|---|
| Gelatin | 0.5 g |
| Sodium polystyrenesulfonate (average molecular weight: 500000) | 10 mg |
| Redox compound described in Table 3 (Powder having an average diameter of 0.1 μm which is dispersed by ZrO beads) | 50 mg |
| SA-2 | 0.4 mg |
| **Receipt 2 (Composition of silver halide emulsion layer 1)** | |
| Silver halide emulsion A2 | 1.5 g |
| Sensitizing dye d-1 | 6 mg |
| Sensitizing dye d-2 | 3 mg |
| Redox compound described in Table 3 (Powder having an average diameter of 0.1 μm which is dispersed by ZrO beads) | 50 mg |
| Thallium nitrate | 0.5 mg/mole Ag |
| Hydrazine compound H-6 | $2\times10^{-3}$ moles/mole Ag |
| Hydrazine compound H-7 | $2\times10^{-3}$ moles/mole Ag |
| Amine compound AM-1 | 40 mg |
| Compound e | 100 mg |
| Polymer latex (described in Example 1 of JP O.P.I. 4-359254/1992) | 0.5 g |
| Hardener g | 5 mg |
| SA-2 | 0.7 mg |
| Saponine | 20 mg |
| 2-mercapto-6-hydroxypurine | 1 mg |

-continued

| | |
|---|---|
| Ascorbic acid | 20 mg |
| EDTA | 50 mg |
| Sodium polystyrenesulfonate | 10 mg |
| Receipt 3 (Composition of interlayer) | |
| Gelatin | 0.5 g |
| Sodium polystyrenesulfonate (Average molecular weight: 500000) | 10 mg |
| Dye SS-1 (Precipitated from an alkaline solution by neutralization with citric acid, average particle diameter: 0.08 μm) | 20 mg |
| SA-2 | 0.4 mg |
| Receipt 4 (Composition of silver halide emulsion layer 2) | |
| Silver halide emulsion A1 | 1.5 g |
| Sensitizing dye d-1 | 0.5 mg |
| Dye SS-1 (Precipitated from an alkaline solution by neutralization with citric acid, average particle diameter: 0.08 μm) | 20 mg |
| Hydrazine compound H-6 | $2 \times 10^{-3}$ moles/mole Ag |
| Hydrazine compound H-7 | $2 \times 10^{-3}$ moles/mole Ag |
| Amino compound AM-1 | 20 mg |
| SA-2 | 1.7 mg |
| 2-mercapto-6-hydroxypurine | 1 mg |
| EDTA | 50 mg |
| Styrene/maleic acid copolymer (Molecular weight: 70000) | 10 mg |
| Polymer latex (described in Example 1 of JP O.P.I. 4-359254/1992) | 0.5 g |
| As the gelatin, phthalated gelatin was used. pH value of the coating solution was 4.8. | |
| Receipt 5 (Composition of emulsion protective layer) | |
| Gelatin | 0.6 g |
| Amino compound AM-1 | 20 mg |
| Sodium iso-amyl-n-decylsulfosuccinate | 12 mg |
| Matting agent: | |
| Spherical polymethyl methacrylate particles, average diameter: 3.5 μm | 25 mg |
| Irregular-shape silica, average diameter: 8 μm | 12.5 mg |
| 1,3-vinylsulfonyl-2-propanol | 40 mg |
| Surfactant h | 1 mg |
| Lubricant (Silicone oil) | 4 mg |
| Colloidal silica (Average diameter: 0.05 μm) | 20 mg |
| Hardener j | 30 mg |
| Sodium polystyrenesulfonate | 10 mg |
| Receipt 6 (Composition of backing layer) | |
| gelatin | 0.6 g |
| Sodium iso-amyl-n-decylsulfosuccinate | 5 mg |
| Latex polymer f | 0.3 g |
| Colloidal silica (Average diameter: 0.05 μm) | 70 mg |
| Sodium polystyrenesulfonate | 10 mg |
| Compound i | 100 mg |
| Receipt 7 (Composition of polymer layer) | |
| Latex (methyl methacrylate: Acrylic acid = 97:3) | 1.0 g |
| Hardener g | 6 mg |
| Receipt 8 (Composition of backing protective layer) | |
| Gelatin | 0.4 g |
| Matting agent: Monodispersed polymethyl methacrylate, average diameter: 5 μm | 50 mg |
| Sodium di-(2-ethylhexyl)-sulfosuccinate | 10 mg |
| Surfactant h | 1 mg |
| Dye k | 20 mg |
| $H-(OCH_2CH_2)_{68}OH$ | 50 mg |
| Hardener g | 20 mg |
| Sodium polystyrenesulfonate | 10 mg |
| Zinc hydroxide | 50 mg |

-continued
Sensitizing dye d-1
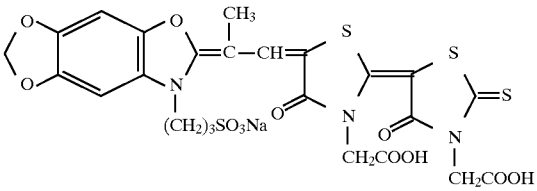
Sensitizing dye d-2
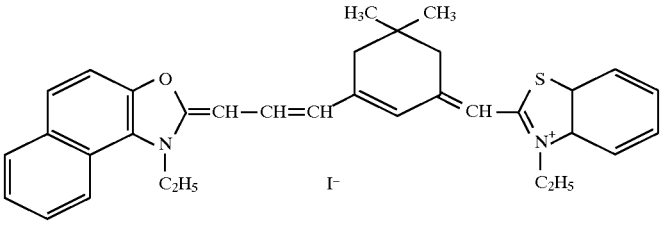
Compound e
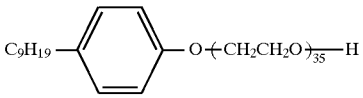
Latex polymer f
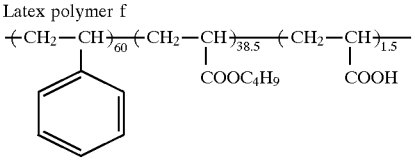
Amino compound MA-1
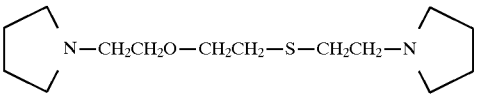
Hardener g
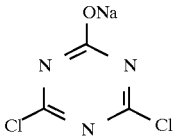
Hardener h
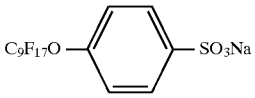
Hardener j
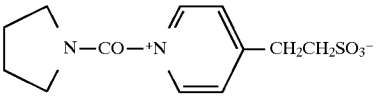
Compound i
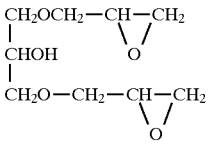
Dye k
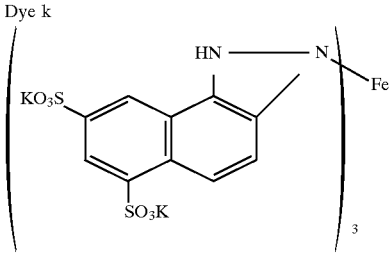

-continued

Dye SS-1

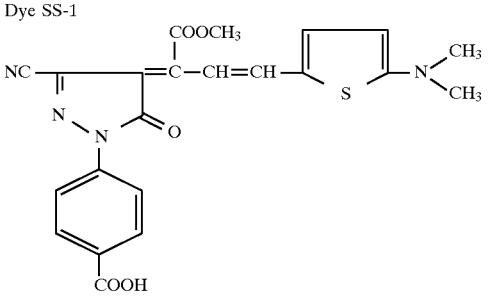

The evaluation was carried out by the same condition of exposing and processing as in Example 1.

Besides, in advance to the above evaluation, samples were prepared each by singly coating the respective emulsion (another emulsion was omitted from the above-mentioned receipts). The samples were subjected to sensitometry by exposing to high-intensity light for $10^{-5}$ seconds through an interference filter of 633 nm and the sensitivity thereof were evaluated by reciprocal of the exposure amount necessary to form a density of 4. As a result, it was proved that the sensitivity of Emulsion A2 was lower 12.5% than that of Emulsion A1.

(Evaluation of black spots)

Processed samples were visually evaluated through a magnifier with a magnification ratio of 100, and classified to ranks 5, 4, 3, 2 and 1 according to the following standards.

5: No black-spot is formed

4: Although black-spots are formed slightly, there is no problem for practical use.

3: Degree of black-spots formation is worst limitation of acceptance for practical use.

4: Degree of black-spots formation is not acceptable for practical use.

5: Black-spots were formed considerably in all area of the sample.

Results of the evaluation are listed in the following Table 3.

In the above, B-ps is rank of black-spots formation.

It is proved that the samples of the invention are higher in the sensitivity and contrast and smaller in the black-spot formation. Further it is proved from the evaluation simulating storage that the samples of the invention is stable because the sensitivity change, increasing in the fogging and in the formation of black-spots during the storage are also small. The emulsions sensitized with elemental sulfur fine particles formed by mixing the alcohol solution of elemental sulfur and water are superior to those sensitized by elemental sulfur particles prepared by powdering by means of zilconia beads in the inhibited black-spots formation and the lowered fog increasing by the incubation test.

Example 3

(Preparation of solid dispersion of sensitizing dye)

The Following sensitizing dyes A and B were added in a weight ratio of 100:1 to water previously adjusted at 27° C. and dispersed by stirring by a high-speed stirring machine or dissolver with a speed of 3,500 rpm for 30 to 120 minutes to obtained a solid dispersion of sensitizing dyes. Then the concentration of the dispersion was adjusted so as the concentration of sensitizing dye A to be 2% by weight.

Sensitizing dye A: 5,5'-dichloro-9-ethyl-3,3'-di-(3-sulfopropyl)oxacarbocyanine salt anhydrous Sensitizing dye B: 5,5'-di-(butoxycarbonyl)-1,1'-diethyl-3,3'-di-(4-sulfobutyl)benzimidazolocarbocyanine sodium salt anhydrous

TABLE 3

| Sample | Redox | Without storage | | | | Stored for 3 days at 50° C. and 50% RH | | | | |
|---|---|---|---|---|---|---|---|---|---|---|
| No. | comp. | Sens. | Gamma | Fog | B-sp | Sens. | Gamma | Fog | B-sp | Note |
| 5 | No. 21 | 180 | 15.5 | 0.038 | 3 | 250 | 11.6 | 0.170 | 1 | Comp. |
| 6 | No. 102 | 170 | 15.1 | 0.039 | 2 | 270 | 11.3 | 0.190 | 1 | Comp. |
| 7 | No. 21 | 240 | 15.7 | 0.021 | 5 | 248 | 14.6 | 0.026 | 5 | Inv. |
| 8 | No. 22 | 230 | 15.6 | 0.022 | 5 | 240 | 14.3 | 0.030 | 4 | Inv. |
| 9 | No. 102 | 220 | 15.2 | 0.020 | 5 | 230 | 14.6 | 0.028 | 5 | Inv. |
| 10 | No. 103 | 238 | 15.8 | 0.024 | 5 | 245 | 15.0 | 0.030 | 5 | Inv. |
| 11 | No. 42 | 241 | 15.6 | 0.025 | 5 | 244 | 15.1 | 0.031 | 5 | Inv. |
| 12 | No. 21 | 260 | 15.8 | 0.021 | 5 | 262 | 16.0 | 0.021 | 5 | Inv. |
| 13 | No. 21 | 262 | 15.7 | 0.022 | 5 | 265 | 15.9 | 0.022 | 5 | Inv. |

| (Preparation of hexagonal tabular grain seed emulsion) | |
|---|---|
| Solution A | |
| Ossein gelatin | 60.2 g |
| Distilled water | 20.0 l |
| $HO—(CH_2CH_2O)_n-[CH(CH_3)CH_2O]_{17}—(CH_2CH_2O)_mH$ n + m = 5 to 7, 10% methanol solution | 5.6 ml |
| Potassium bromide | 26.8 g |
| 10% sulfuric acid | 144 ml |
| Solution B | |
| Silver nitrate | 1487.5 g |
| Make up with distilled water to | 3500 ml |
| Solution C | |
| Potassium bromide | 1050 g |
| Potassium iodide | 29.3 g |
| Make up with distilled water to | 3500 ml |
| Solution D | |
| 1.75 N aqueous solution of potassium bromide | An amount necessary to adjust the silver electrode potential to the following value |

To Solution A, 64.1 ml of Solution B and Solution C are each added at 35° C. spending 2 minutes using a mixing apparatus described in Japanese Examined Patent Nos. 58-58288/1983 and 58-58289/1983 to prepare nuclei.

After stopping the addition of Solutions A and B, the temperature of Solution A containing the nuclei was raised to 60° C. spending 60 minutes. Then Solutions A and B were simultaneously added to Solution A by the double-jet mixing method with a flowing rate of 68.5 ml per minute for 50 minutes. While this process, the silver electrode potential measured by means of a silver ion selective electrode and a saturated silver-silver chloride electrode as comparative electrode, is controlled using Solution D so as to be +6 mV. After addition of Solutions B and C, the pH value of the mixed solution was adjusted to 6 by a 3% solution of potassium hydroxide and was desalted. Thus seed emulsion EM-A was obtained. It is proved by electronmicroscopic observation that the grains occupying not less than 90% of the total projection area of the grains of seed emulsion EM-A were hexagonal tabular grains having a maximum adjacent side length ratio 1.0 to 2.0, an average thickness of hexagonal tabular grains of 0.5 μm and a variation coefficient of grain diameter distribution of 25%.

(Preparation of $AgBr_{0.45}Cl_{0.55}$ tabular grain emulsion)

An emulsion comprising tabular grains composed of 45 mole-% of silver bromide and 55 mole-% of silver chloride was prepared using the following four solutions.

| Solution A | |
|---|---|
| Ossein gelatin | 29.4 g |
| $HO—(CH_2CH_2O)_n-[CH(CH_3)CH_2O]_{17}—(CH_2CH_2O)_mH$ n + m = 5 to 7, 10% methanol solution | 1.25 ml |
| Seed emulsion EM-A | An amount corresponding to 0.98 moles of silver halide |

-continued

| | |
|---|---|
| Make up with distilled water to | 3000 ml |
| Solution B | |
| 3.50-N aqueous solution of silver nitrate | 2240 ml |
| Solution C | |
| Sodium chloride | 455 g |
| Potassium bromide | 473 g |
| Make up with distilled water to | 2240 ml |
| Solution E | |
| 1.75-N sodium chloride solution | An amount necessary to adjust the silver electrode potential to the following value |

To Solution A, Solutions B and C are simultaneously added according to a double-jet mixing method at 35° C. spending 110 minutes using a mixing apparatus described in Japanese Examined Patent Nos. 58-58288/1983 and 58-58289/1983. The flow rate of each of the solutions was controlled so that the flow rate at the end of the addition was three times of that at the initiation of addition. While the mixing process, the silver electrode potential of the emulsion was controlled so as to adjust to 100 mV by using Solution D.

After mixing of the solutions, a flocculation desalting was carried out for removing excessive salts. It was proved by electronmicroscopic observation of 3000 grains that the grains occupying not less than 80% of the total projection area of the grains of the emulsion were tabular grains which have (100) surface as main surface, an aspect ratio of not less than 8, an average diameter of 1.17 μm, an average thickness of 0.12 μm and a variation coefficient of grain diameter distribution of 24%.

Thus obtained emulsion was divided to 7 parts, and spectrally and chemically sensitized in the following manner to obtain chemically sensitized emulsions B-1 through B-7.

To each of the divided emulsions heated at 50° C., the above-mentioned dispersion of sensitizing dyes was added so as the amount of dyes to be 460 mg per mole of silver. Then $7.0\times10^{-4}$ moles per mole of silver, potassium chloroaurate and elemental silver further were added. The emulsions were chemically ripened for 120 minutes at 50° C. The amount and the form the elemental sulfur are described in Table 4. After ripening, the above-mentioned fine grain silver iodide was added to the emulsion in an amount of $3\times10^{-3}$ moles per mol of silver. Then the emulsions were stabilized by $3\times10^{-2}$ mole per mole silver of 4-hydroxy-6-methyl-1,3,3a,7-tetraazaindene.

TABLE 4

| Emulsion No. | Adding status of elemental sulfur | Amount of sulfur (moles/mole Ag) | Note |
|---|---|---|---|
| B1 | Methanol solution | $2 \times 10^{-5}$ | Comparative |
| B2 | Methanol solution | $4 \times 10^{-5}$ | Comparative |
| B3 | A | $2 \times 10^{-5}$ | Inventive |
| B4 | A | $4 \times 10^{-5}$ | Inventive |
| B5 | B | $2 \times 10^{-5}$ | Inventive |
| B6 | B | $4 \times 10^{-5}$ | Inventive |
| B7 | C | $2 \times 10^{-5}$ | Inventive |

In the above table the status of elemental sulfur, A to C are represent the followings, respectively.

A: Powder having an average diameter of 0.5 μm, powdered by zirconia beads.

B: Dispersed particles having an average diameter of 0.5 μm formed by mixing a methanol solution of elemental sulfur with water C: Dispersed particles having an average diameter of 0.3 μm formed by mixing a methanol solution of elemental sulfur with water (Preparation of Sample)

Samples 14 through 20 were prepared in the following manner each using the above Emulsions B1 through B7, respectively. To each the emulsions the emulsions, the following additives were added to prepare emulsion coating solutions. In the followings, the adding amounts of additives were described in terms of moles per mole of silver.

| | |
|---|---|
| t-Butyl-catechol | 400 mg |
| Polyvinylpyrrolidone (Molecular weight: 10,000) | 1.0 g |
| Styrene-maleic anhydride copolymer | 2.5 g |
| Trimethylolpropane | 10 g |
| Diethylene glycol | 5 g |
| Nitrophenyl-triphenyl-phosphonium chloride | 50 mg |
| Ammonium 1,3-dihydroxybenzene-4-sulfonate | 4 g |

-continued

| | |
|---|---|
| Sodium 2-mercaptobenzimidazoles-5-sulfonate | 1.5 mg |
| $n\text{-}C_4H_9OCH_2CH(OH)CH_2N(CH_2COOH)_2$ | 1 g |
| 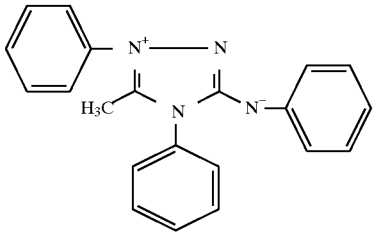 | 150 mg |
| 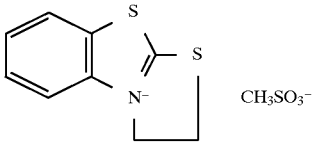 | 70 mg |

A coating solution of protective layer having the following composition was prepared.

| | |
|---|---|
| Matting agent: Polymethyl methacrylate particle, average diameter: 7 μm | 7 mg |
| Colloidal si1ica, average diameter: 0.013 μm | 70 mg |
| Bis-vinylsulfonylmethylether of sodium 2,4-dichloro-6-hydroxy-1,3,5-trizine | 36 mg |
| 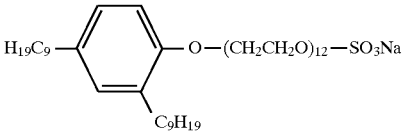 | 12 mg |
| 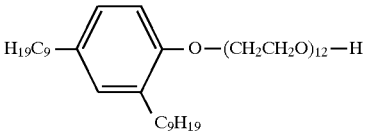 | 2 mg |
| $CH_2COO(CH_2)_9CH_3$<br>\|<br>$CHCOO(CH_2)_2CH(CH_3)_2$<br>\|<br>$SO_3Na$ | 7 mg |
| 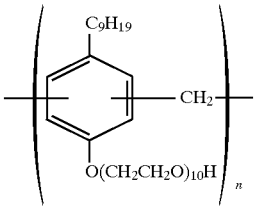 Mixture of n = 2 to 5 | 15 mg |
| $F_{19}C_9O-(CH_2CH_2O)_{10}-CH_2CH_2OH$ | 3 mg |
| $NaO_3S-CHCOOCH_2(C_2F_4)_3H$<br>\|<br>$CH_2COOCH_2(C_2F_4)_3H$ | 5 mg |

The above-mentioned coating solutions was coated on the both sides of a subbed blue-tinted polyethylene terephthalate film base of 175 μm thick and dried to prepare samples 1 through 10. The coating amount per one side of silver and gelatin of the emulsion layer were 1.8 g/m$^2$ and 1.7 g/m$^2$, respectively, and that of gelatin of the protective layer was 0.95 g/m$^2$. Thus obtained samples were separated to 2 groups, and one of them was incubated for 3 days at 50° C. and 50% RH.

A cross-over cutting layer containing the following dye a in a form of dispersion is provided between the subbing layer and the emulsion layer in advance of coating of coating of the emulsion layer. The coating amount of the cross-over cutting layer was 0.25 g/m$^2$ in terms of dye and 0.4 g/m$^2$ in terms of gelatin peer one side of the sample.

Dye a

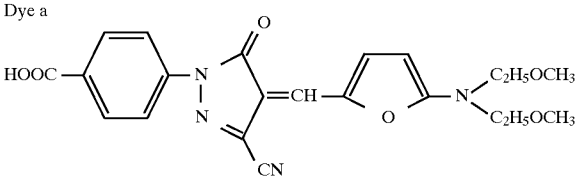

(Preparation of dispersion of dye a)

Water, surfactant Alkanol XC (alkylnaphthalenesulfonate produced by du Pont), Dye a and zirconia beads were put into a ball-mill and dispersed for 4 days.

Then a gelatin solution was added to the mixture and the beads were removed to prepare a coating solution.

(Evaluation)

The samples were exposed to light with a color temperature of 2856° K from a tungsten lump through a monochromatic color filter having a transparency peak at 545 nm and a half band width of approximately 10 μm for simulating light emitted from a fluorescent intensifier for X-ray radiography, and an optical wedge.

The samples were processed in an automatic processor SRX-503 using Processing Solutions SR-DF, either manufactured by Konica Corporation, at 35° C. for 45 sec in total. The replenishing amounts of developer and fixer were each 210 ml/m$^2$, respectively.

The processed samples were subjected to densitometry in an ordinary manner to determine the sensitivity and fog of the samples. The sensitivity is expressed by reciprocal of exposure amount necessary for forming an image density of 1.0 on the fog density. The sensitivity shown in the following table is relative value when the sensitivity of Sample No. 14 is set as 100. Thus obtained results are listed in Table 5.

TABLE 5

| Sample No. | Emulsion No. | Sensitivity | Fog | Fog after incubation | Note |
|---|---|---|---|---|---|
| 14 | B1 | 100 | 0.070 | 0.150 | Comparative |
| 15 | B2 | 130 | 0.090 | 0.180 | Comparative |
| 16 | B3 | 105 | 0.022 | 0.029 | Inventive |
| 17 | B4 | 133 | 0.026 | 0.032 | Inventive |
| 18 | B5 | 106 | 0.011 | 0.015 | Inventive |
| 19 | B6 | 135 | 0.015 | 0.018 | Inventive |
| 20 | B7 | 108 | 0.010 | 0.012 | Inventive |

It is understood form the result shown in the above table that the samples according to the invention are lower in the fogging without any lowering in the sensitivity, and increasing of the fog during the storage in the high temperature and humidity is also lower than those in the comparative samples. Further it is shown that the samples using the solid dispersions formed by mixing the sulfur solution of water are lower in the fog value and increasing of fog caused by the storage in the high temperature and humidity than those of the samples using the sulfur powdered by zirconia beads.

What is claimed is:

1. A silver halide photographic light-sensitive material comprising a support, and provided thereon, a silver halide emulsion layer and optionally a non-light-sensitive hydrophilic colloid layer provided on the support adjacent to said silver halide emulsion layer, wherein said silver halide emulsion layer comprises a silver halide emulsion chemically sensitized in the presence of a water-insoluble sulfur sensitizer which is added to the silver halide emulsion in a form of a dispersion of solid particles; and when the non-light-sensitive hydrophilic colloid layer is not provided, said silver halide emulsion layer contains a hydrazine compound and when the non-light-sensitive hydrophilic colloid layer is provided, at least one of said silver halide emulsion layer and said non-light-sensitive hydrophilic colloid layer adjacent to said silver halide emulsion layer contains the hydrazine compound.

2. The light-sensitive material of claim 1, wherein said sulfur sensitizer is a water-insoluble thiourea derivative or elemental sulfur.

3. The light-sensitive material of claim 2, wherein said sulfur sensitizer is elemental sulfur.

4. The light-sensitive material of claim 2, wherein said sulfur sensitizer is a thiourea derivative represented by Formula I:

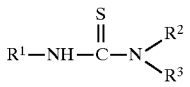

Formula I wherein $R^1$ is a residue of heterocyclic group including a nitrogen atom or a sulfur atom; $R^2$ is a hydrogen atom, a lower alkyl group, an allyl group or an aryl group; $R^3$ is synonymous with $R^1$ or $R^2$ and $R^2$ may be combined with $R^3$ to form a heterocyclic ring.

5. The light-sensitive material of claim 1, wherein said fine particles of a water-insoluble sulfur sensitizer have an average diameter of 0.050 μm to 0.6 μm.

6. The light-sensitive material of claim 1, wherein a redox compound capable of releasing a development inhibiting agent upon oxidation reaction of the redox compound is contained in said silver halide emulsion layer or said hydrophilic layer adjacent to said silver halide emulsion layer.

7. The light-sensitive material of claim 6, wherein said redox compound is contained in the silver halide emulsion layer provided at the position nearest to the support or said hydrophilic layer adjacent to said silver halide emulsion layer.

8. The light sensitive material of claim 4 wherein said thiourea derivative is selected from the group consisting of

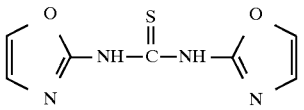

S-1

-continued
S-2
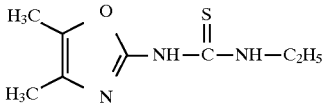
S-3
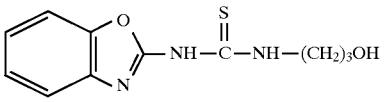
S-4
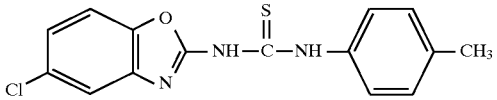
S-5
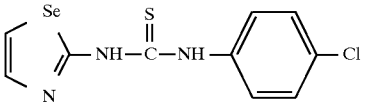
S-6
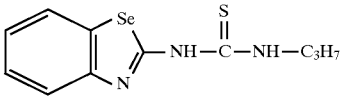
S-7
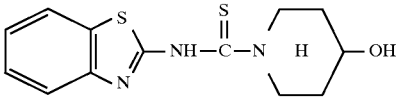
S-8
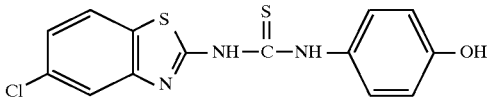
S-9
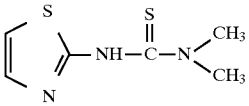
S-10
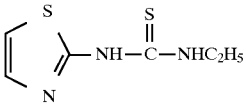
S-11
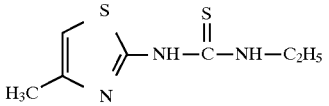
S-12
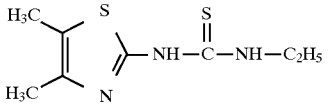
S-13
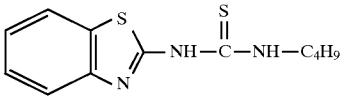
S-14
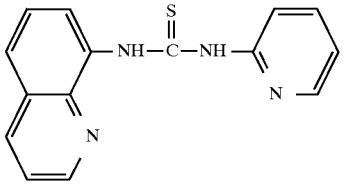
-continued
S-15
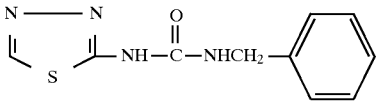
S-16
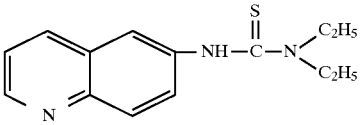
S-17
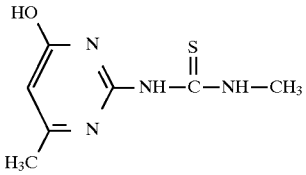
S-18
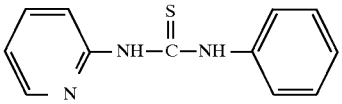
S-19
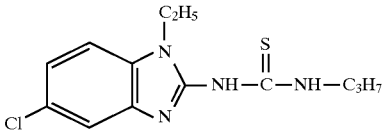
S-20
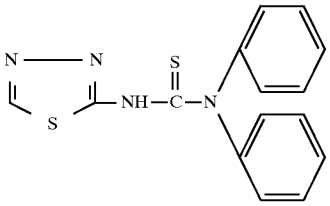
S-21
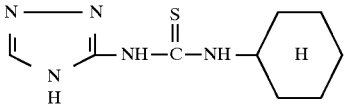
S-22
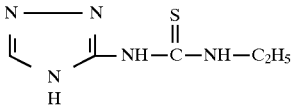
S-23
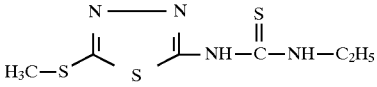
S-24
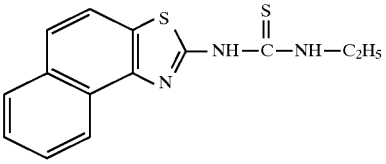
S-25
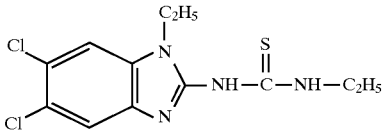
and -continued

S-26

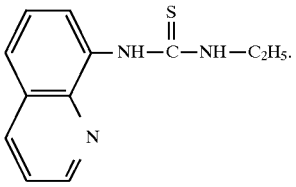

9. The light-sensitive material of claim 8, wherein said fine particles of a water-insoluble sulfur sensitizer have an average diameter of 0.050 μm to 0.6 μm.

10. The light-sensitive material of claim 3, wherein said fine particles of a water-insoluble sulfur sensitizer have an average diameter of 0.050 μm to 0.6 μm.

11. The light sensitive material of claim 1 wherein the hydrazine compound is

H-1

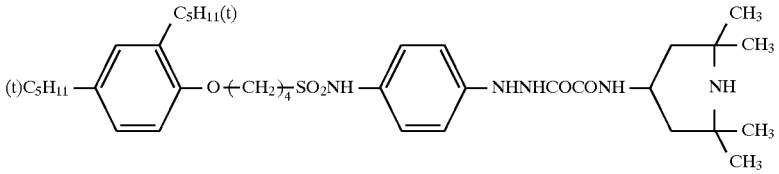

H-2

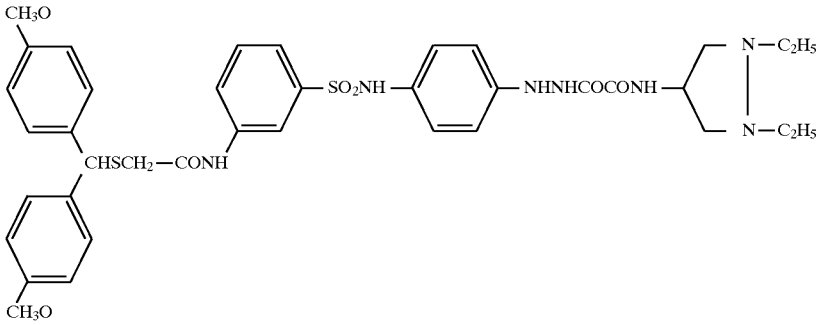

H-3

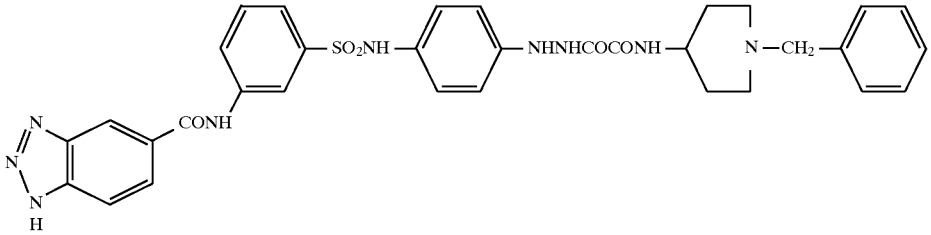

H-4

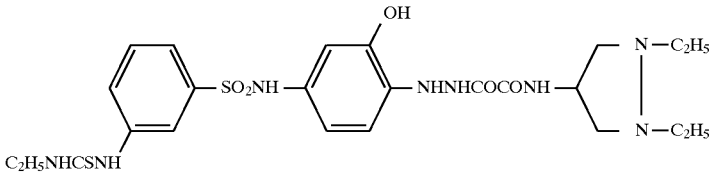

H-5

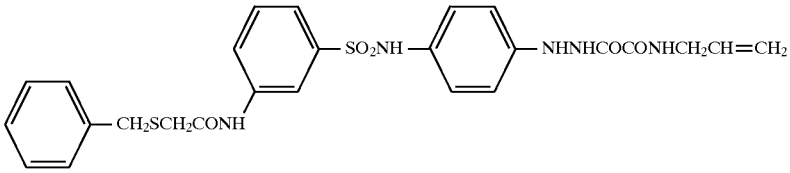

H-6

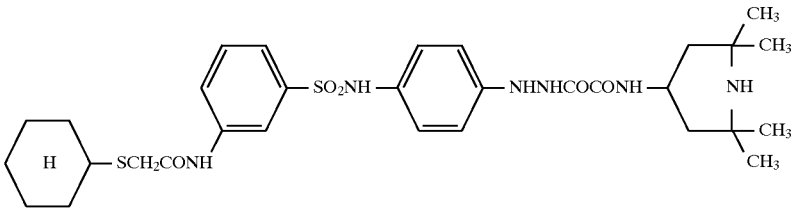

-continued
H-7
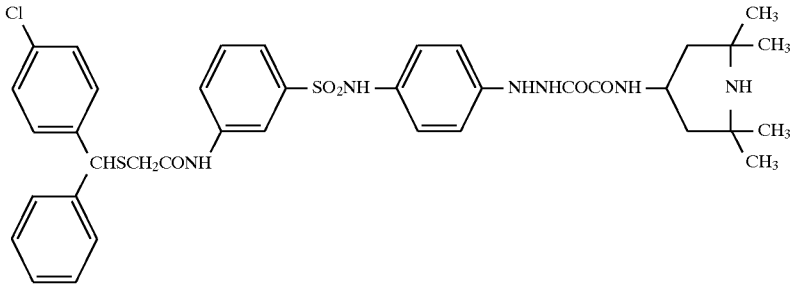
H-8
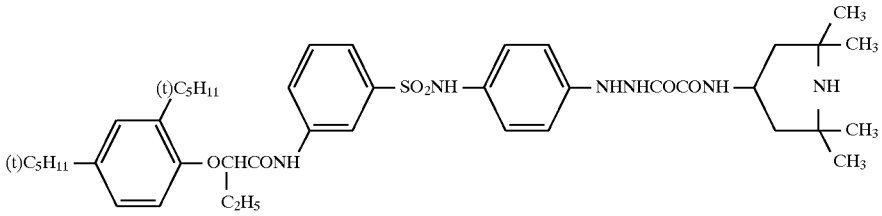
H-9
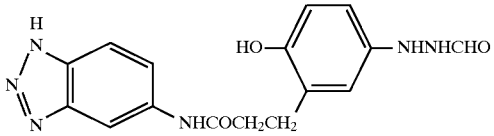
H-10
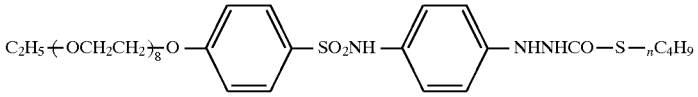
H-11
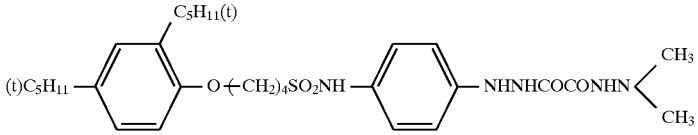
H-12
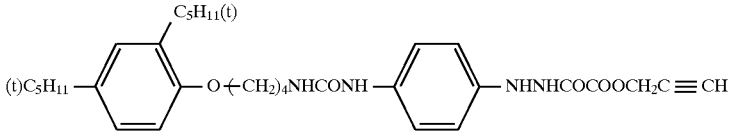
H-13
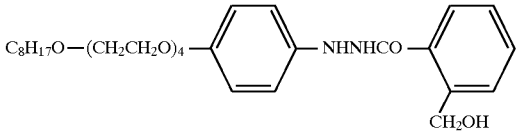
H-14
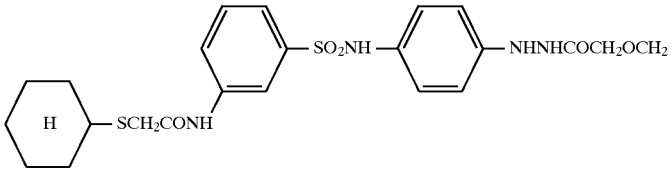
H-15
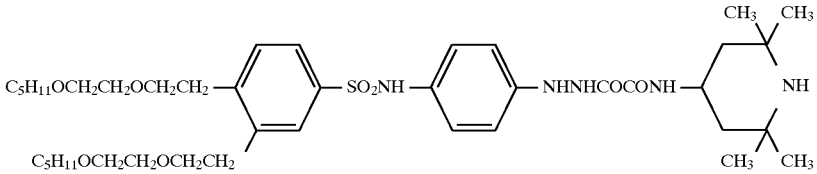

-continued
H-16
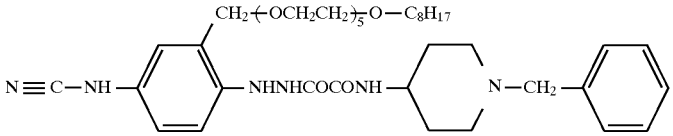
H-17
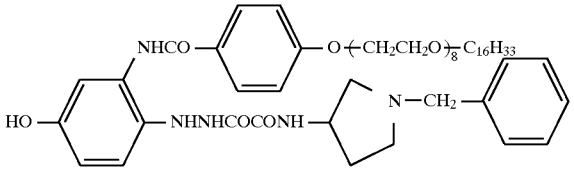
H-18
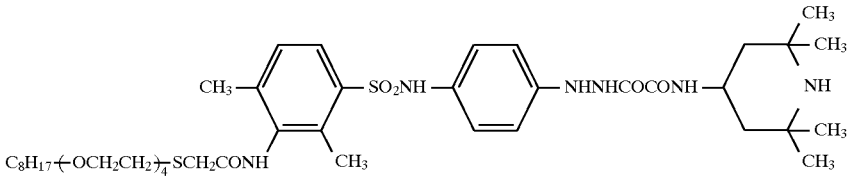
H-19
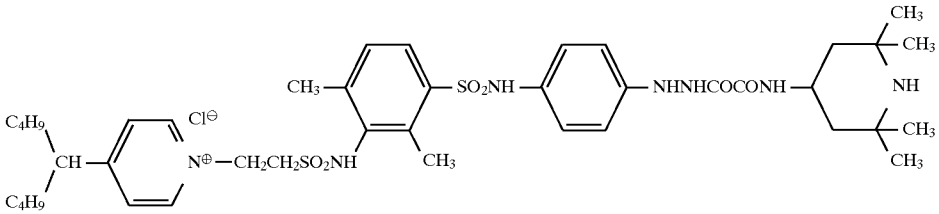
H-20
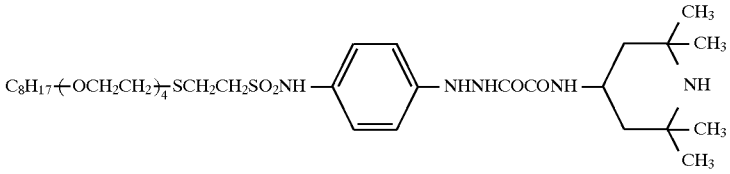
H-21
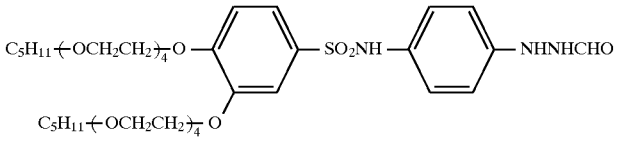
H-22
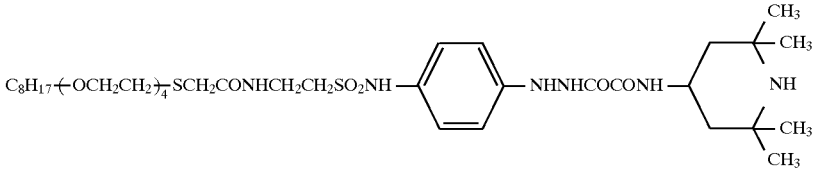
H-23
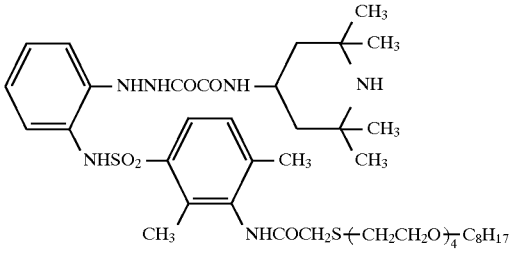

-continued
H-24
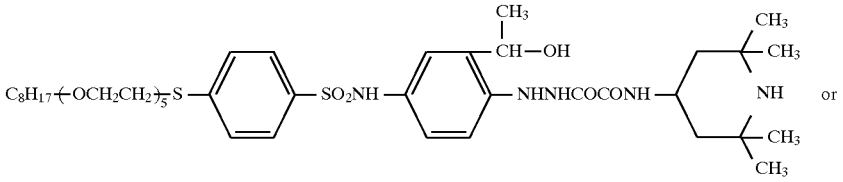
or
H-25
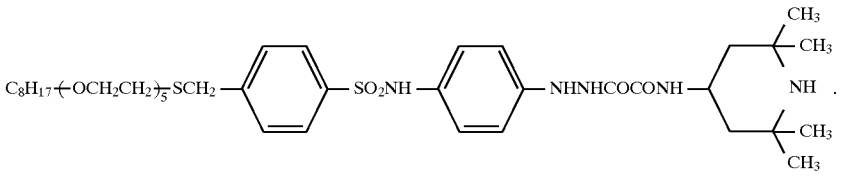
.
* * * * *